US006220072B1

(12) United States Patent
Tado et al.

(10) Patent No.: US 6,220,072 B1
(45) Date of Patent: Apr. 24, 2001

(54) FORMING PRESS OF CRANKSHAFTS

(75) Inventors: Masashi Tado, Iyomishima; Koichi Kondo, Niihama, both of (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/449,641

(22) Filed: Nov. 30, 1999

(30) Foreign Application Priority Data

Dec. 16, 1998 (JP) ..... 10-357689
Nov. 1, 1999 (JP) ..... 11-310824

(51) Int. Cl.[7] ..... B21D 11/14; B21D 53/84

(52) U.S. Cl. ..... 72/299; 29/6.01

(58) Field of Search ..... 72/299, 404, 453.18, 72/300, 298; 29/6.01

(56) References Cited

U.S. PATENT DOCUMENTS 1,274,390 * 8/1918 Damerell ..... 29/6.01
2,414,549 * 1/1947 Nowak ..... 72/299
5,295,381 * 3/1994 Nishikawa ..... 72/299

FOREIGN PATENT DOCUMENTS 3-243241 * 10/1991 (JP) ..... 72/299

* cited by examiner

*Primary Examiner*—Daniel C. Crane
(74) *Attorney, Agent, or Firm*—Arent Fox Kintner Plotkin & Kahn, PLLC

(57) ABSTRACT

The present invention relates to a forming press of crankshafts which is safe, has a slide of large strength and high forming precision, and is capable of high-speed cyclic operation. A forming press of crankshafts includes a forging unit for twisting and a forging unit for reshaping, wherein (i) a twisting oil-hydraulic cylinder is mounted on the crown, (ii) twisting push rods are disposed along outer surfaces of the slide, and (iii) the bottom ends of the twisting push rods are connected by twisting-down beams and untwisting beams. The slide is of inverted T-form in section, and the pressing block is of H-form as seen from above and of inverted U-form as seen from one side. Therefore, they do not interfere with each other and a large stroke can be secured. The twisting angle is set using an upper stopper provided in the pressing block and an automatic telescopic lower stopper provided in the slide and freely movable toward and away from the upper stopper. An upper guide and a lower guide are provided between the pressing block and the slide. Each guide directs four portions, around the lower stopper, of the pressing block against its forward, backward, rightward, and leftward deviation.

10 Claims, 25 Drawing Sheets

Reshaping stage I

Twisting stage II

Die-opening stage III

Upper die section-untwisting stage IV

Reshaping stage I

Twisting stage II

Die-opening stage III

Upper die section-untwisting stage IV

FORMING PRESS OF CRANKSHAFTS

BACKGROUND OF THE INVENTION

The present invention relates to a forming press of crankshafts.

A one-piece crankshaft is forged in stages of closed die forging, twisting, and reshaping. Although the stage of closed die forging consists of the substages of preforming, rough closed die forging, finishing closed die forging, and trimming, all the four substages are being performed with a single forging press since it is required in all the four substages to apply pressure to the workpiece in only the downward direction. On the other hand, because the twisting stage and the reshaping stage require different pressing modes, the two stages were being performed with two different forging presses. However, because using two different forging presses for the two stages is disadvantageous in terms of equipment cost and man-hours, forming presses have recently been developed which, in a single unit, are capable of performing both the twisting and reshaping stages. The present invention relates to such a forming press.

A forming press of crankshafts is disclosed in the Japanese Examined Patent Publication No. 4640/H7 (1995), which is shown in FIG. 25.

In the above forming press, a slide 106 is secured to the lower ends of the piston rods of piston cylinders 108, which are mounted on the crown. An upper die holder 151 is secured to the bottom of the slide 106. The upper section of a twisting die 101 and the upper section of a reshaping die 102 are fixed to the bottom of the upper die holder 151. On the other hand, the lower sections of the twisting die 101 and the reshaping die 102 are mounted on a lower die holder 152, which is mounted on the base of the forming press. The twisting die 101 and the reshaping die 102 are built in so that the upper and lower sections of the twisting die 101 and those of the reshaping die 102 join at one and the same height when the slide 106 comes down. When the slide 106 descends, a workpiece is caught between the upper and lower sections of the twisting die 101 and, at the same time, another workpiece in the reshaping die is pressed and reshaped. While the slide 106 is in its bottom position, the twisting oil-hydraulic cylinder 109 provided in the slide 106 contracts to lower push rods 171 penetrating the slide 106 and twist the workpiece in the twisting die 101.

In this way, a workpiece can be reshaped in the reshaping die 102 and, at the same time, another workpiece can be caught between the upper and lower sections of the twisting die 101. Then, the workpiece in the twisting die 101 can be twisted by contracting the twisting oil-hydraulic cylinder 109, pushing down the push rods 171, and thereby turning parts of the twisting die 101 anticlockwise and the other parts of the twisting die 101 clockwise.

In case of the above forming press, because the twisting oil-hydraulic cylinder 109 is disposed in the slide 106, it is necessary for feeding hydraulic oil to the twisting oil -hydraulic cylinder 109 to use long flexible hoses 100 which cover the stroke of the slide 106. Such configuration is not desirable for a high-speed production machine which requires a large flow of hydraulic oil, posing a large danger of hydraulic oil leaking from the long flexible hoses 100, igniting from the heat of the hot forging, and causing a fire.

Besides, to bring the lower ends of the push rods 171 to the push-down arms 104 of movable retainers holding the twisting die 101, the slide 106 has to allow the push rods 171 to penetrate itself. In this configuration, the following shortcomings occur.

(1) The adjustment and maintenance of the guiding parts of the push rods are difficult.

(2) Because the slide 106 is divided into three by the push rods 171, its strength is reduced. To solve this problem, the height of the slide 106 has to be increased to recover its strength.

(3) Accordingly, the slide system (moving section) becomes heavy. Its large force of inertia impedes the control of high-speed cyclic operation.

One of the main objects of developing a forming press which performs both the twisting and reshaping stages is to achieve a high-speed operation. In case of the above forming press of the prior art, the object is difficult to achieve due to the reasons described in the above paragraphs (2) and (3). If the forming press achieves the object, it would present problems in forming precision and maintenance.

On the other hand, the twisting angle of such a forming press has to be changed in accordance with the types of crankshafts. The twisting angle varies depending on the numbers of cylinders, etc. of engines.

In conventional means for setting the twisting angle, stoppers are set, below the push rods, on the top of the bed to regulate the twisting angle. To shift the production from one type of crankshaft to another, stoppers have to be changed and adjusted to attain the twisting angle required by the latter.

Such stoppers have to be changed and adjusted by workers in accordance with twisting angles required by various types of crankshafts. Besides, because the space in the forming press is limited, the upper and lower die holders are usually taken out of the press in order to make fine adjustment of the stoppers. Accordingly, working efficiency is low.

Under the circumstances, another forming press is disclosed [Japanese Unexamined Utility Model Publication 104215/H4 (1992)]. The forming press has, under its bed, a driving mechanism which moves threaded shafts up and down to adjust the height of the stoppers.

However, because the driving mechanism is disposed under the bed, die lubricant and scale stick to the driving mechanism and hence it is liable to develop trouble. Besides, because the forming press has four stoppers, they require fine height adjustment among them. Therefore, the driving mechanism for adjusting the height of stoppers is very complex and expensive.

In accordance with the above, an object of the present invention is to provide a forming press of crankshafts of which the safety is high, of which the slide has large strength ensuring high precision, and which is capable of high-speed operation and inexpensive.

Another object of the present invention is to provide a forming press of crankshafts of which the twisting angle can be set freely and precisely, of which the construction is simple, and which is inexpensive to make and is capable of high-precision forming.

SUMMARY OF THE INVENTION

According to the first aspect of the present invention, there is provided a forming press of the crankshafts having a crown, a slide, a forging unit for twisting with a twisting die, and a forging unit for reshaping, wherein (i) a pressing oil-hydraulic cylinder and a lift-up oil-hydraulic cylinder for lowering and raising the slide and a twisting oil-hydraulic cylinder for twisting a workpiece in the forging unit for twisting are mounted on the crown, (ii) the piston rod of the twisting oil-hydraulic cylinder is connected to a pressing block, (iii) a twisting push rod is secured to each of the four corners of the pressing block, two of the four twisting push rods being disposed in front and back of the slide on the right side of the twisting die, the other two being disposed in front and back of the slide on the left side of the twisting die, and (iv) the lower ends of the two twisting push rods on each side of the twisting die are connected to each other by a twisting-down beam and an untwisting beam below the slide.

According to the second aspect of the present invention, there is provided the forming press of the first aspect, wherein the slide is of inverted T-form in section, the pressing block is of inverted U-form as seen from one side, and the slide and the pressing block are so disposed to each other that the former can enter the latter.

According to the third aspect of the present invention, there is provided the forming press of the second aspect, wherein (i) the pressing block comprises a guide shoe and a pair of block members secured to the front and the back of the guide shoe, (ii) a pair of guide members for guiding the guide shoe upward and downward is mounted on the slide, and (iii) the slide has four guide pipes for guiding the four twisting push rods.

According to the fourth aspect of the present invention, there is provided the forming press of the third aspect, wherein the slide and a member provided as a unit with the slide are mounted with a lower stopper to define the descending limit of the pressing block relative to the slide and an upper stopper to define the ascending limit of the pressing block relative to the slide.

According to the fifth aspect of the present invention, there is provided the forming press of the fourth aspect, wherein (i) a directional control valve is put in a hydraulic-oil feeding and discharging circuit which connects the head-side and rod-side oil chambers of the twisting oil-hydraulic cylinder to a pressurized-oil source, (ii) an opening and closing valve is put in a hydraulic-oil line which connects the head-side oil chamber of the twisting oil-hydraulic cylinder to an oil tank, and (iii) a relief valve and an opening and closing valve are put in series in a hydraulic-oil line which connects the rod-side oil chamber of the twisting oil-hydraulic cylinder to the oil tank.

According to the sixth aspect of the present invention, there is provided the forming press of the first aspect, wherein a means for setting the twisting angle is provided between the pressing block and the slide, the means comprising an upper stopper provided in the pressing block and an automatic telescopic lower stopper provided in the slide and freely movable toward and away from the upper stopper.

According to the seventh aspect of the present invention, there is provided the forming press of the sixth aspect, wherein the automatic telescopic lower stopper of the means for setting the twisting angle comprises (i) an internally threaded cylinder freely rotatable about its vertical axis in a casing which is provided in the slide, (ii) an externally threaded member which engages with the internal-thread portion of the internally threaded cylinder, (iii) a stopper block fixed on the top of the externally threaded member, and (iv) a driving mechanism for rotating the internally threaded cylinder.

According to the eighth aspect of the present invention, there is provided the forming press of the seventh aspect, wherein the driving mechanism of the automatic telescopic lower stopper comprises (i) a worm wheel formed on the outer surface of the internally threaded cylinder, (ii) a worm which engages with the worm wheel, and (iii) a geared motor for rotating the worm.

According to the ninth aspect of the present invention, there is provided the forming press of the sixth aspect, wherein a means for guiding the ascent and descent of the pressing block is provided between the pressing block and the slide, the means comprising (i) an upper guiding means which includes four guide sliders attached to the four corners of the upper portion of the pressing block, a guide structure mounted fixedly on the top of the slide, and four guide rails attached to the guide structure for guiding the guide sliders and (ii) a lower guiding means which includes four guide sliders attached to the four corners of the lower portion of the pressing block and four guide rails attached to the slide for guiding the four guide sliders.

According to the tenth aspect of the present invention, there is provided the forming press of the ninth aspect, wherein the guide slider and the guide rail, at each corner of the pressing block, of each of the upper guiding means and the lower guiding means are so configured that the guide slider consists of two parts and the guide rail consists of two parts, and one set of a guide-slider part and a guide-rail part guides the pressing block against its deviation to the front or the rear, as the case may be, of the forming press and the other set of a guide-slider part and a guide-rail part guides the pressing block against its deviation to the right or the left, as the case may be, of the forming press.

The advantages offered by the first aspect of the invention are mainly as follows. Because the twisting oil-hydraulic cylinder is fixed to the press frame by mounting the cylinder on the press crown, it is not necessary to use flexible hoses; fixed piping can be made. Therefore, the forming press is safe and easy in maintenance and poses no danger of fire from the heat of hot forging. Besides, hydraulic oil can be fed in a large flow rate to achieve high-speed operation of the forming press. Moreover, because the slide is not divided by the twisting push rods, the slide can be designed compact yet strong. By making the slide system light in this way, the controllable operating speed of the forming press can be increased. Furthermore, its high rigidity ensures a high precision. In addition, by securing the upper ends of the twisting push rods to the pressing block and connecting the lower ends of the twisting push rods with the twisting-down beams and the untwisting beams, high rigidity can be given to the twisting push rods, which contributes to weight reduction and high-speed operation.

The advantages offered by the second aspect of the invention are mainly as follows. Because the slide and the pressing block are so configured and disposed to each other that the former can enter the latter, the up and down strokes of the slide and the pressing block can easily be secured and the forming press can be made compact yet strong. Besides, guides and stoppers for the pressing block can easily be arranged.

The advantage offered by the third aspect of the invention is as follows. Because the pressing block is guided by the pair of guide members and the twisting push rods are guided by the guide pipes, their up and down movement is regulated orthogonally to the slide. Thus, the forming precision increases.

The advantages offered by the fourth aspect of the invention are as follows. Because the upper and lower limits of the stroke of the pressing block are mechanically defined, the safety operation is ensured. In addition, because the relative position of the twisting push rods to the slide can be determined exactly at their top and bottom positions, the forming precision increases.

The advantage offered by the fifth aspect of the invention is mainly as follows. The directional control valve controls the extension and contraction of the twisting oil-hydraulic cylinder. In addition, the opening and closing valve opened allows the hydraulic oil in the twisting oil-hydraulic cylinder to return to the oil tank and, on the other hand, the relief valve generates back pressure. All these actions cause the twisting mechanism to follow the slide. Thus, the relative position of the twisting mechanism to the slide is kept constant, and thereby the forming precision is increased.

The advantages offered by the sixth aspect of the invention are as follows. With only one means for setting the twisting angle provided between the pressing block and the slide, the stroke of the pressing block can be defined. Such a mechanism for fine height adjustment among multiple lower stoppers as conventional forging presses require is unnecessary. Therefore, the forming press can be constructed simply and inexpensively. Besides, by extending and contracting the lower stopper provided in the slide, the spacing between the upper stopper of the pressing block and the lower stopper can be changed. Thus, the descending stroke of the twisting push rods fixed to the pressing block and hence the twisting angle can be adjusted as desired. Moreover, because the lower stopper extends and contracts automatically, the twisting angle is adjusted automatically, which raises the press-work productivity.

The advantages offered by the seventh aspect of the invention are as follows. When the driving mechanism rotates the internally threaded cylinder about its vertical axis, the externally threaded member engaging with the internal-thread portion of the internally threaded cylinder moves up and down together with the stopper block on it. In this way, just by rotating an internally threaded cylinder, the spacing between the upper stopper and the stopper block and hence the twisting angle can be adjusted. Such a mechanism for fine height adjustment among multiple lower stoppers as conventional presses require is unnecessary. Therefore, the forming press can be constructed simply and inexpensively. Besides, the threaded fitting of the externally threaded member into the internally threaded cylinder can be configured so as to prohibit them from turning in the reverse direction when the upper stopper is pressed on the stopper block. Therefore, the stopper block remains in its set position, and hence high forming precision can be achieved.

The advantages offered by the eighth aspect of the invention are as follows. Because a worm and a worm wheel are used, a minute feed of the lower stopper is possible, enabling high-precision setting of the twisting angle. Besides, because the worm and the worm wheel do not turn in the reverse direction under the downward force exerted by the upper stopper, the stopper block remains in its set position. Therefore, high forming precision is achieved.

The advantage offered by the ninth aspect of the invention is mainly as follows. Because the upper guiding means guides the four corners of the upper portion of the pressing block relatively to the slide and the lower guiding means guides the four corners of the lower portion of the pressing block relatively to the slide, the pressing block does not slant and hence the twisting push rods are pressed down exactly vertically. Accordingly, with only one telescopic lower stopper as the means for setting the twisting angle, the four twisting push rods can be pressed down to one and the same level. Therefore, an exact twisting angle can be given to workpieces.

The advantage offered by the tenth aspect of the invention is mainly as follows. Each of the upper guiding means and the lower guiding means guides the pressing block at every corner with a set of a guide-slider part and a guide-rail part against forward and backward deviation and another set of a guide-slider part and a guide-rail part against rightward and leftward deviation. Therefore, the pressing block slants neither forward or backward nor rightward or leftward. Accordingly, the twisting push rods do not slant and, therefore, press work of a precise twisting angle can be accomplished.

BRIEF DESCRIPTION OF THE DRAWINGS

The features and advantages of the present invention will become more clearly appreciated from the following description in conjunction with the accompanying drawings, in which.

DETAILED DESCRIPTION OF THE PREFERRED EMBODIMENTS

With reference to the drawings, preferred embodiments of the present invention will now be described.

(First Embodiment of the Invention)

Figure 1:
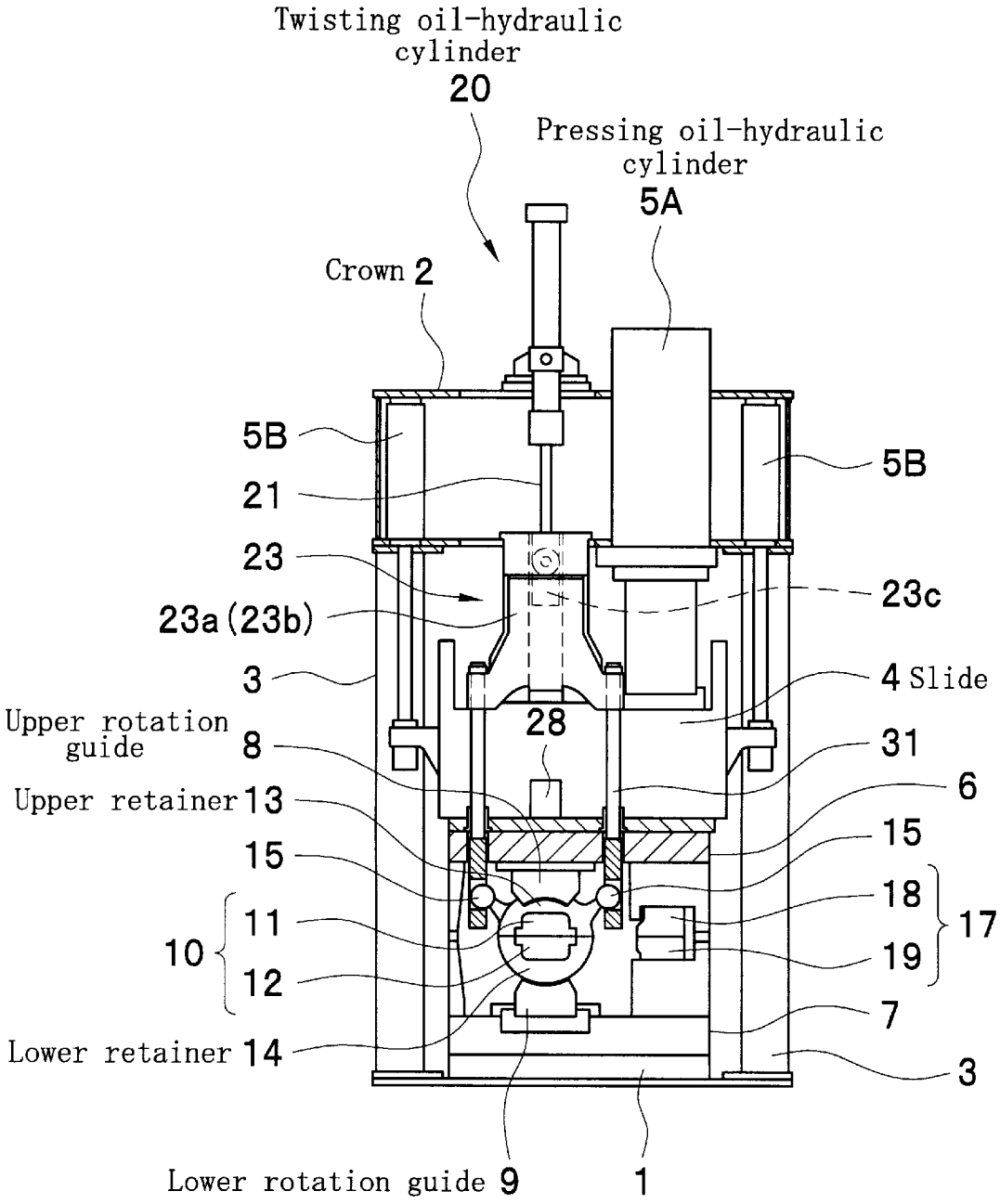
FIG. 1 is a front view of an embodiment of forming press of crankshafts of the present invention.

Referring to FIG. 1, the basic structure of an embodiment of forming press of crankshafts of the invention will first be described.

The numeral 1 represents a bed hard plate; 2, a crown; 3, columns connecting the bed hard plate 1 and the crown 2. The numeral 4 indicates a slide. The signs 5A and 5B represent a pressing oil-hydraulic cylinder and lift-up oil-hydraulic cylinders, respectively, both mounted on the crown 2. When the rod-side chambers of the lift-up cylinders 5B are opened, the slide 4 descends, hydraulic oil being sucked from a tank into the pressing cylinder 5A. The slide 4 is of inverted T-form in section.

An upper die holder 6 is secured to the bottom of the slide 4. A lower die holder 7 is mounted on the top of the bed hard plate 1. An upper rotation guide 8 and the upper section 18 of a reshaping die 17 are secured to the bottom of the upper die holder 6. A lower rotation guide 9 and the lower section 19 of the reshaping die 17 are mounted on the top of the lower die holder 7.

The twisting die 10 consists of an upper section 11 and a lower section 12. The upper section 11 is fitted in an upper retainer 13, which is journaled in the upper rotation guide 8. The lower section 12 is fitted in a lower retainer 14, which is journaled in the lower rotation guide 9.

Figure 4:
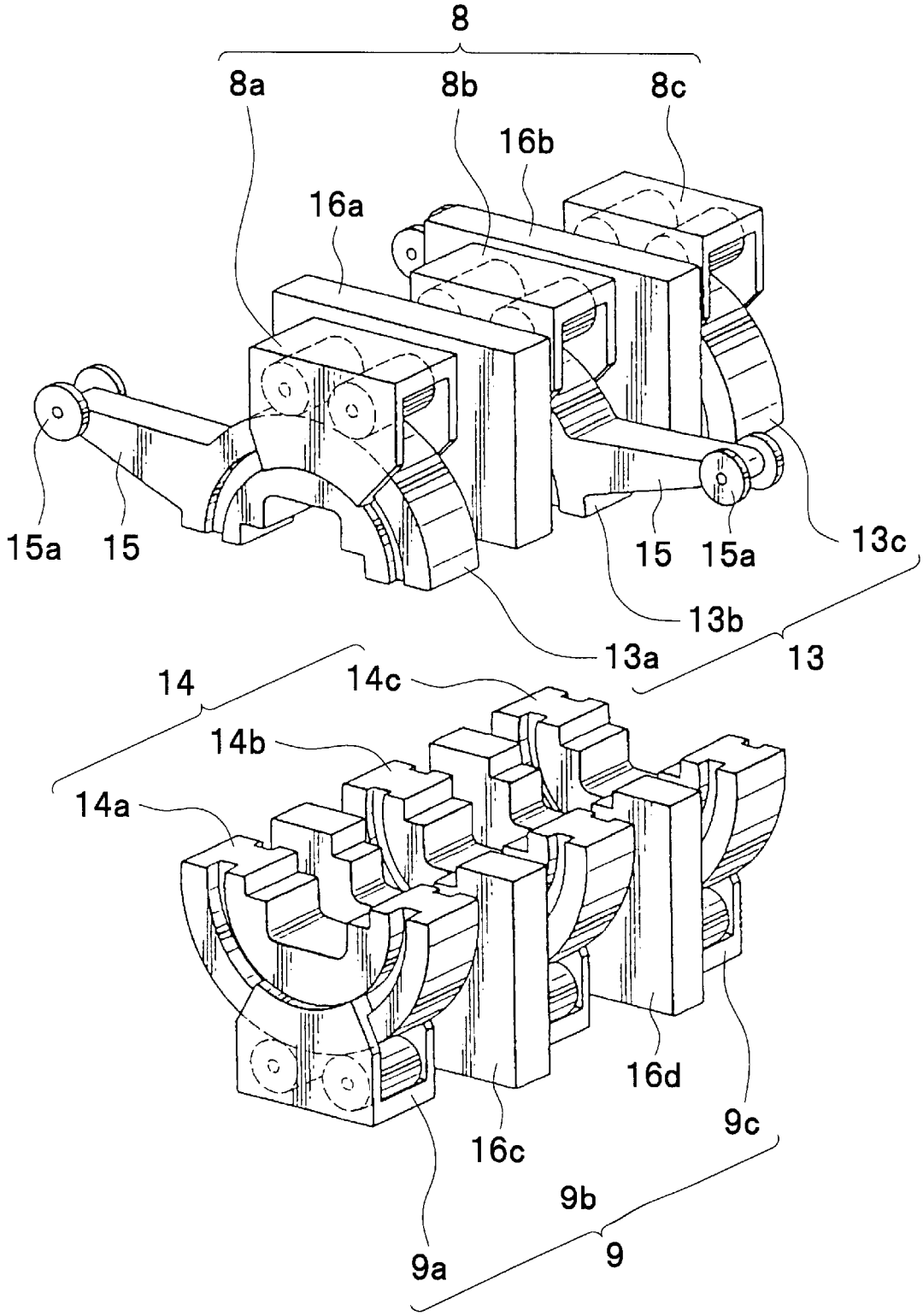
FIG. 4 is a perspective view of the forging unit for twisting of the forming press of FIG. 1.

With reference to FIG. 4, the details of the forging unit for twisting will now be described. The upper rotation guide 8 consists of three guide elements 8*a*, 8*b*, and 8*c*. The upper retainer 13 also consists of three retainer elements 13*a*, 13*b*, and 13*c*. Each retainer element has a push-down arm 15. The push-down arms 15 project in upper right and upper left directions alternately. A pair of rollers 15*a* is journaled on the upper end of each push-down arm 15. Disposed between the retainer elements 13*a*, 13*b*, and 13*c* are upper-fixed-die-section holders 16*a* and 16*b*, which are fixed to the upper die holder 6 (see FIG. 1).

The lower rotation guide 9 also consists of three guide elements 9*a*, 9*b*, and 9*c*. The lower retainer 14 also consists of three retainer elements 14*a*, 14*b*, and 14*c*. Disposed between the retainer elements 14*a*, 14*b*, and 14*c* are lower-fixed-die-section holders 16*c* and 16*d*, which are fixed to the lower die holder 7 (see FIG. 1).

The upper retainer 13 and the lower retainer 14 are disposed opposite to each other, the former accommodating the upper die section 11, the latter accommodating the lower die section 12. A workpiece is put between the upper and lower die sections 11 and 12, and pressure is applied to the upper die section 11 to fix the workpiece with the upper- and lower-fixed-die-section holders 16*a*, 16*b*, 16*c*, and 16*d*. Then, the push-down arms 15 are pushed down to turn the upper and lower retainer 13 and 14 and hence the twisting die 10 between the upper and lower rotation guides 8 and 9. Thus, the workpiece caught between the upper and lower die sections 11 and 12 is twisted.

Referring to FIG. 1, the forging unit for reshaping will now be described. A workpiece twisted in the forging unit for twisting is put between the upper and lower sections 18 and 19 of the reshaping die 17, and pressure is applied to the upper die section 18 to reshape the workpiece.

The characteristic portion of the forming press will now be described.

In FIG. 1, the numeral 20 represents a twisting oil-hydraulic cylinder, which is mounted on the crown 2. The cylinder may be mounted on the crown either fixedly or by means of trunnions.

In case that the twisting oil-hydraulic cylinder 20 is fixed to the crown 2, the oil pipes to the twisting oil-hydraulic cylinder 20 can be laid fixedly, which eliminates almost completely the danger of fire due to the heat of hot forging. In case that the twisting oil-hydraulic cylinder 20 is mounted on the crown 2 by means of trunnions, flexible hoses are required. However, because the purpose of using the flexible hoses is only to absorb vibration, shorter flexible hoses suffice for the purpose compared with the flexible hoses used for conventional forming presses.

The lower end of the piston rod 21 of the twisting oil-hydraulic cylinder 20 is connected to a pressing block 23. A twisting push rod (hereinafter referred to as "push rod") 31 is secured to each of the four corners of the pressing block 23. These components constitute a twisting mechanism.

Figure 2:
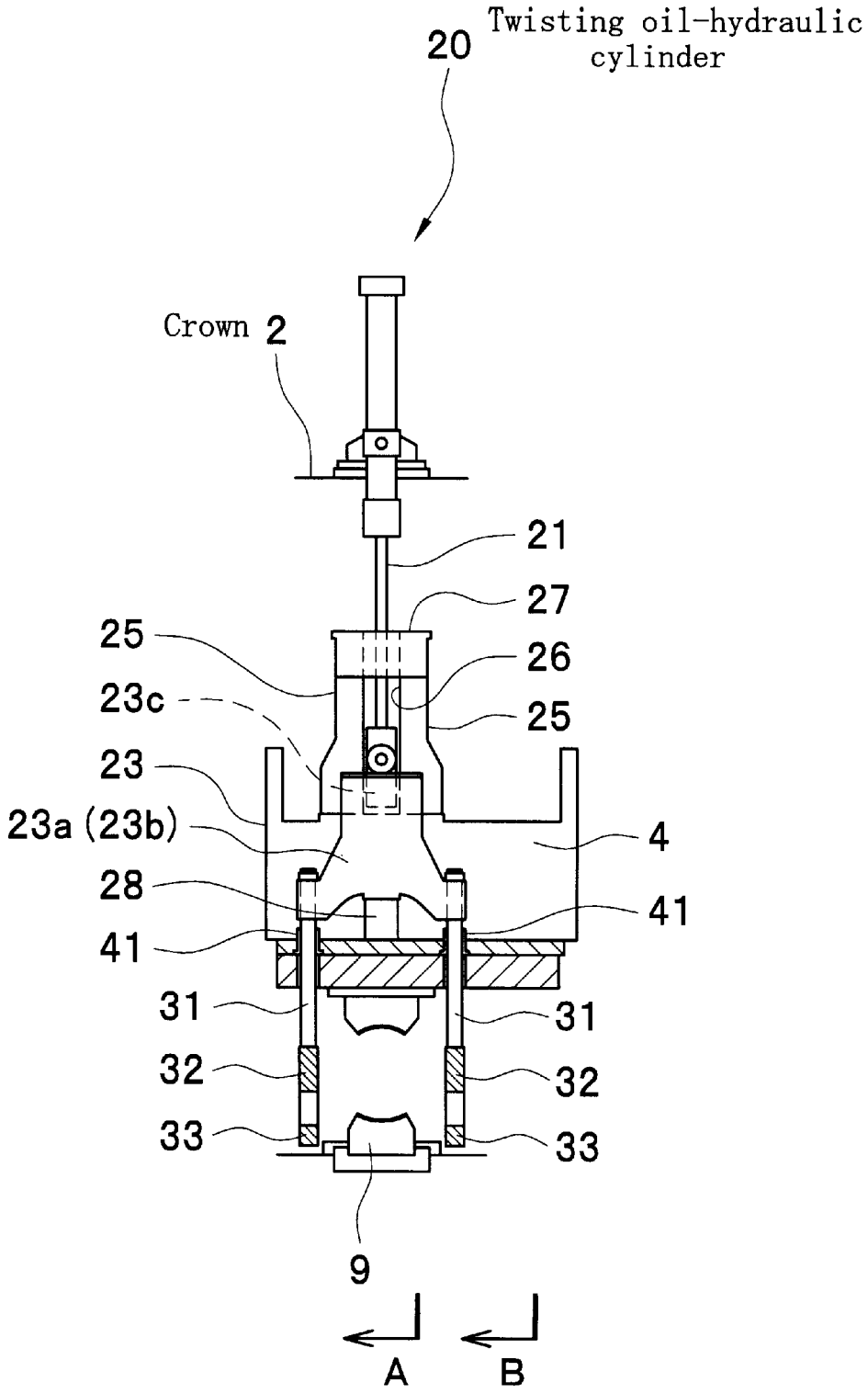
FIG. 2 is a front view of the main part of the forming press of FIG. 1, its twisting oil-hydraulic cylinder extended.
Figure 3A:
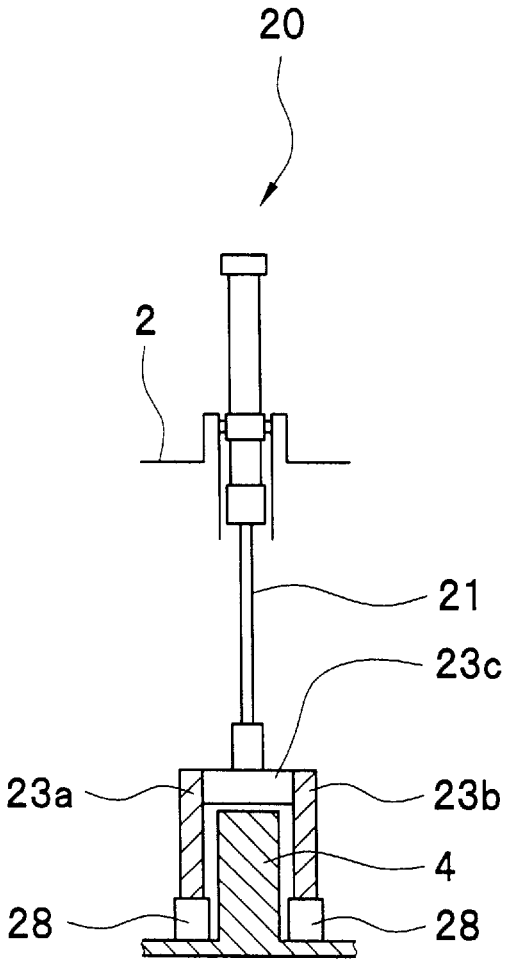
FIG. 3(A) is a view taken along the arrowed line A of FIG. 2.
Figure 3B:
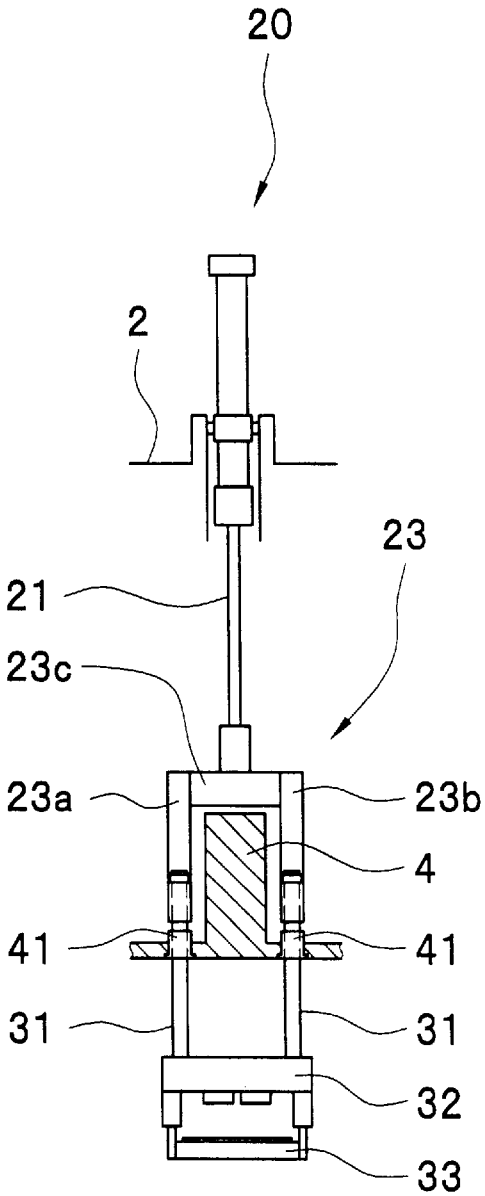
FIG. 3(B) is a view taken along the arrowed line B of FIG. 2.

Referring to FIGS. 2 and 3, the details of the twisting mechanism will be described.

The pressing block 23 comprises a guide shoe 23*c* and block members 23*a* and 23*b* secured to the front and the back of the guide shoe 23*c*, taking an H-like shape as seen from above and an inverted U-like shape as seen from one side. The pressing block 23 is disposed so as to bestride the slide 4. Thus, the twisting mechanism and the slide 4 do not interfere with each other, and a large up-and-down stroke can be secured. Besides, two column-like guide members 25 are erected on the top of the slide 4, and the guide shoe 23*c* moves up and down, sliding in a guide gap 26 formed between the guide members 25 facing to each other. Thus, the pressing block 23 is guided properly in moving up and down relatively to the slide 4. Moreover, guide pipes 41 are provided at right, left, front, and rear parts of the base plate of the slide 4, the base plate being the bottom portion of the slide 4 and formed wide. The four push rods 31 move up and down, guided by the guide pipes 41. Thus, the push rods 31 move up and down, keeping a certain distance from the twisting die 10 (refer to FIG. 1).

An upper stopper 27 is mounted on the guide members 25, and a lower stopper 28 is disposed, on the bottom portion of the slide 4, below each of the block members 23*a* and 23*b*. The up and down strokes of the pressing block 23, or the twisting mechanism, are restricted by these upper and lower stoppers 27 and 28.

As mentioned earlier, four push rods 31 are secured into bosses at the four corners of the pressing block 23. Two push rods 31 are disposed in front and back of the slide 4 (see FIG. 3) on the right side of the twisting die 10 (see FIG. 1); the other two, in front and back of the slide 4 on the left side of the twisting die 10. The bottom portions of the front and rear push rods 31 and 31 on the right side of the twisting die 10 are connected to each other by a twisting-down beam 32 and an untwisting beam 33. In the same way, the bottom portions of the front and rear push rods 31 and 31 on the left side of the twisting die 10 are connected to each other by a twisting-down beam 32 and an untwisting beam 33.

Thus, because the upper ends of the push rods 31 are secured to the pressing block 23 and their lower ends are connected to each other by the twisting-down beams 32 and the untwisting beams 33, the twisting mechanism can be constructed with higher rigidity and less weight.

The rollers 15*a* of the push-down arms 15 of the upper retainer 13 are put between the twisting-down beam 32 and the untwisting beam 33 on each side of the twisting die 10.

Thus, because two or more push-down arms 15 are arranged side by side along the twisting-down beam 32 and the untwisting beam 33, both having a suitable length, on each side of the twisting die 10, it is unnecessary to change the push rods 31, the twisting-down beams 32, and the untwisting beams 33 regardless of different sizes of crankshafts, and hence different sizes of the upper and lower retainers 13 and 14, and hence different positions of the push-down arms 15.

Figure 5:
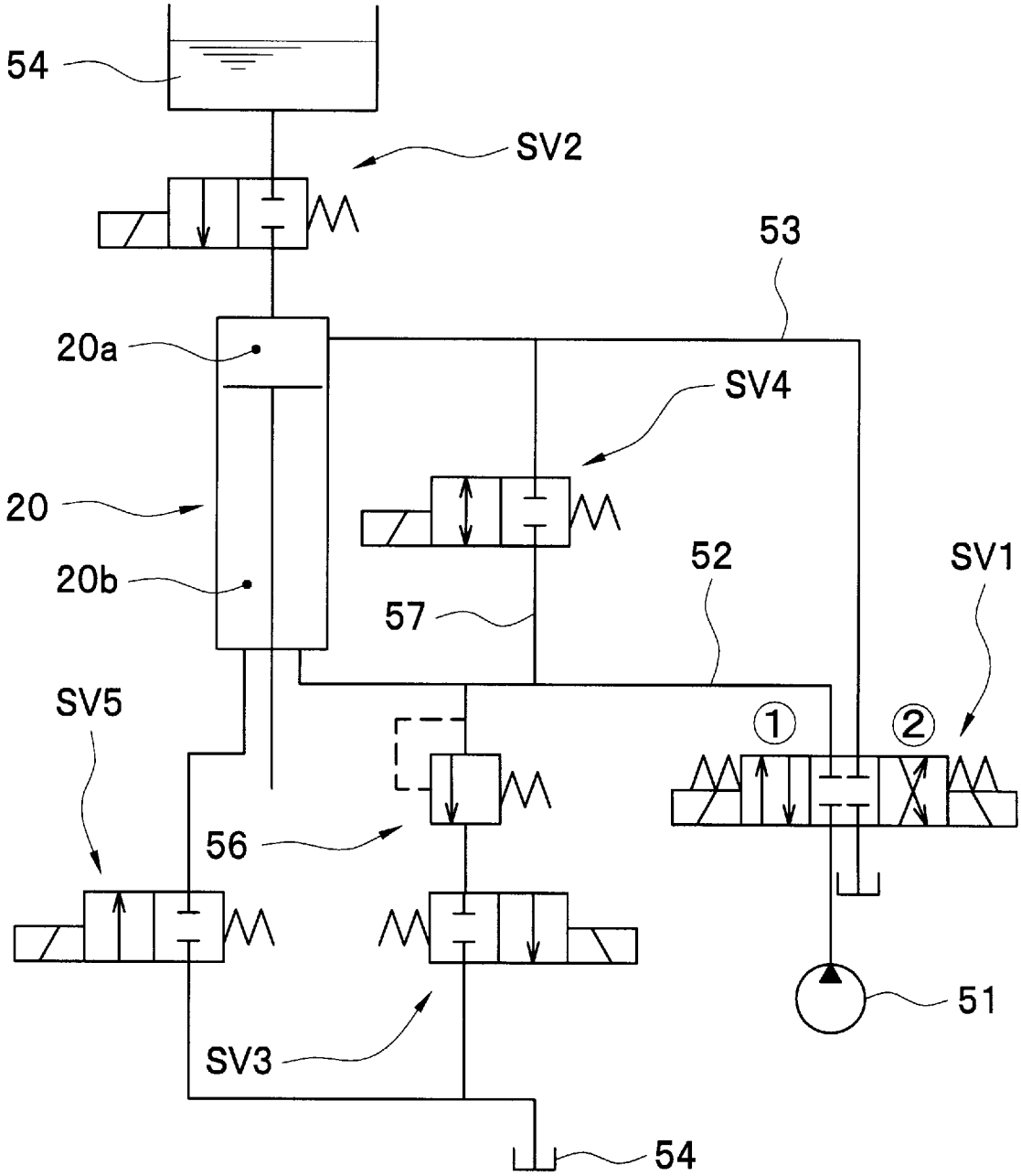
FIG. 5 is an oil-hydraulic circuit diagram of the twisting oil-hydraulic cylinder of the forming press of FIG. 1.

Referring to FIG. 5, the oil-hydraulic circuit of the twisting oil-hydraulic cylinder 20 will be described.

A four-port, three-position directional control valve SV1 is put in oil lines 52 and 53 between the twisting oil-hydraulic cylinder 20 and an oil-hydraulic pump 51 so that hydraulic oil can be fed to the head-side chamber 20*a* and the rod-side chamber 20*b* of the twisting oil-hydraulic cylinder 20. The head-side chamber 20*a* is connected to an oil tank 54 through an opening and closing valve SV2. The rod-side chamber 20*b* is connected to the oil tank 54 through an oil line with an opening and closing valve SV3 and another oil line with an opening and closing valve SV5. A relief valve 56 is put between the rod-side chamber 20*b* and the opening and closing valve SV3. An opening and closing valve SV4 is put in a bypass between the oil lines 52 and 53. The opening and closing valve Sv4 constitutes a differential circuit.

The directional control valve SV1 causes the twisting oil-hydraulic cylinder 20 to extend for twisting movement and contract for untwisting movement. When the directional control valve SV1 shifts to its ① position, hydraulic oil is fed to the rod-side chamber 20*b* to contract the twisting oil-hydraulic cylinder 20. When the directional control valve SV1 shifts to its ② position, hydraulic oil is fed to the head-side chamber 20*a* to extend the twisting oil-hydraulic cylinder 20, and thus a workpiece in the twisting die 10 is given a twist. In addition, when the twisting oil-hydraulic cylinder 20 contracts, the opening and closing valve SV2 opens to return hydraulic oil from the cylinder 20 to the oil tank 54. When the twisting oil-hydraulic cylinder 20 extends, the opening and closing valve SV5 opens to return hydraulic oil from the cylinder 20 to the oil tank 54. Thus, hydraulic oil in the twisting oil-hydraulic cylinder 20 is returned to the oil tank 54 through the valves SV2 and SV5 in addition to the valve SV1.

During a free downward stroke, or high-speed descent, of the slide 4, it is necessary to keep constant the relative position of the four push rods 31 to the slide 4. To accomplish this, the directional control valve SV1 is set neutral, and the opening and closing valves SV2, SV3, and SV4 are opened. The upper stopper 27 rigidly connected to the slide 4 pushes down the guide shoe 23*c*, which pulls down, or extends, the twisting oil-hydraulic cylinder 20. The hydraulic oil in the rod-side chamber 20*b* opens the relief valve 56 to return to the oil tank 54 through the opening and closing valve SV3 and also flows toward the head-side chamber 20*a* through the opening and closing valve SV4. However, as the opening and closing valve SV4 constitutes a differential circuit, back pressure develops between the rod-side chamber 20*b* and the relief valve 56. Therefore, the push rods 31 do not descend more quickly than the slide 4 but descend keeping constant their relative position to the slide 4.

To raise the slide 4, the directional control valve SV1 is set neutral, the opening and closing valves SV2 and SV4 are opened, and the opening and closing valve SV3 is closed. The lower stoppers 28 of the slide 4 being raised by the lift-up oil-hydraulic cylinders 5B push up the pressing block 23, contracting the twisting oil-hydraulic cylinder 20. The hydraulic oil in the head-side chamber 20*a* returns to the oil tank 54 through the opening and closing valve SV2.

On the other hand, hydraulic oil is sucked into the rod-side chamber 20*b* by opening the opening and closing valve SV5. Because the lower stoppers 28 are in contact with the pressing block 23, the relative position of the push rods 31 to the slide 4 is kept constant.

The following table shows the relation between the opening and closing of the valves SV1 to SV4 and the stages in the forming process.

| Stages in forming process | SV1① | SV1② | SV2 | SV3 | SV4 |
|---|---|---|---|---|---|
| Twisting | X | ○ | X | ○ | X |
| Untwisting | ○ | X | ○ | X | X |
| Pressing of Slide 4 | X | X | ○ | ○ | X |
| Slide 4's idie descent | X | X | ○ | ○ | ○ |
| Slide 4's ascent | X | X | ○ | X | ○ |

○:open
X: close

Referring to FIGS. 6 to 10, the crankshaft-forming process of the forming press will be described.

Figure 6:
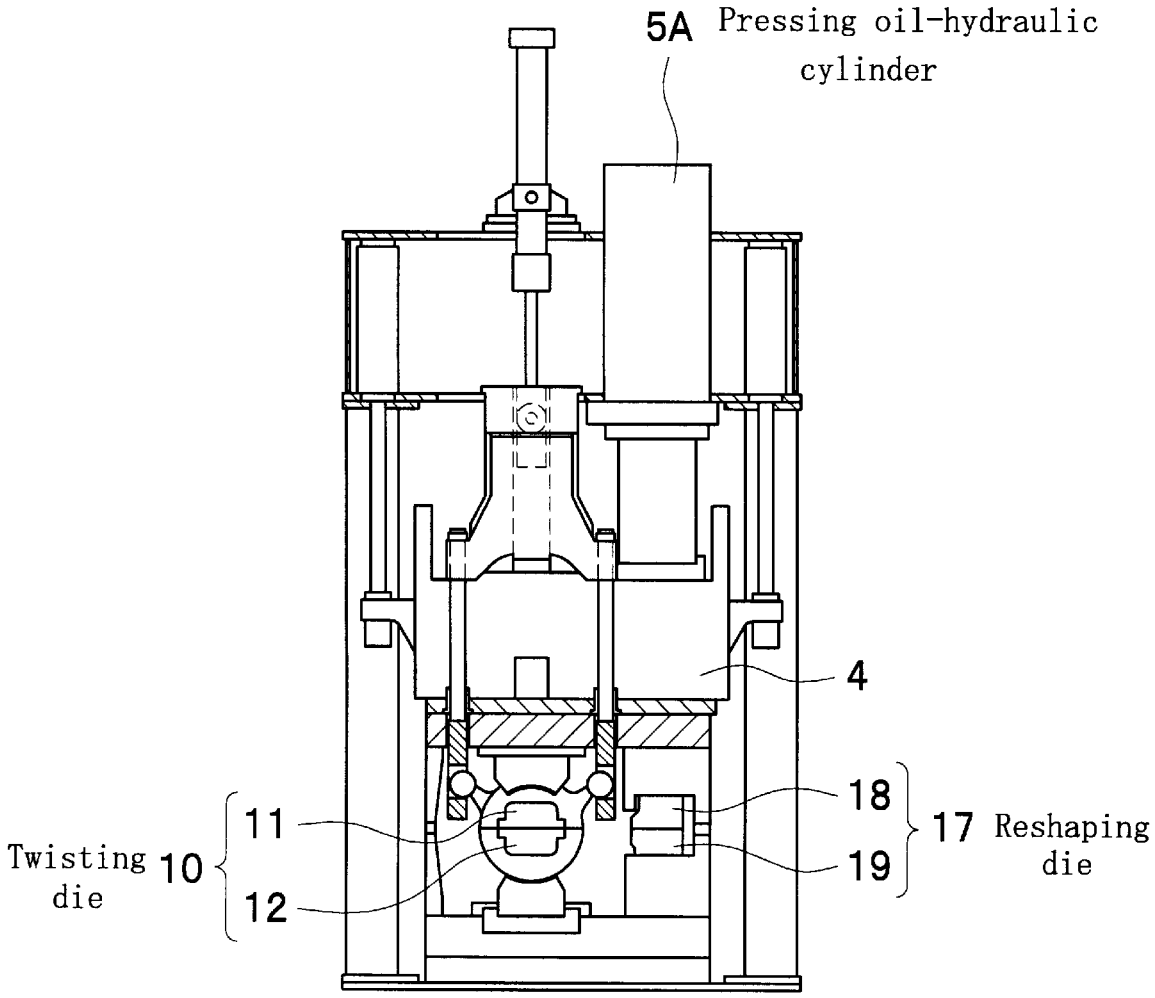
FIG. 6 is an explanatory drawing of the reshaping stage I of the forming press of FIG. 1.

In the reshaping stage I shown in FIG. 6, the pressing oil-hydraulic cylinder 5A extends to push down the slide 4, a workpiece not yet twisted is caught between the upper and lower sections 11 and 12 of the twisting die 10, and another workpiece already twisted is pressed and reshaped in the reshaping die 17.

Figure 7:
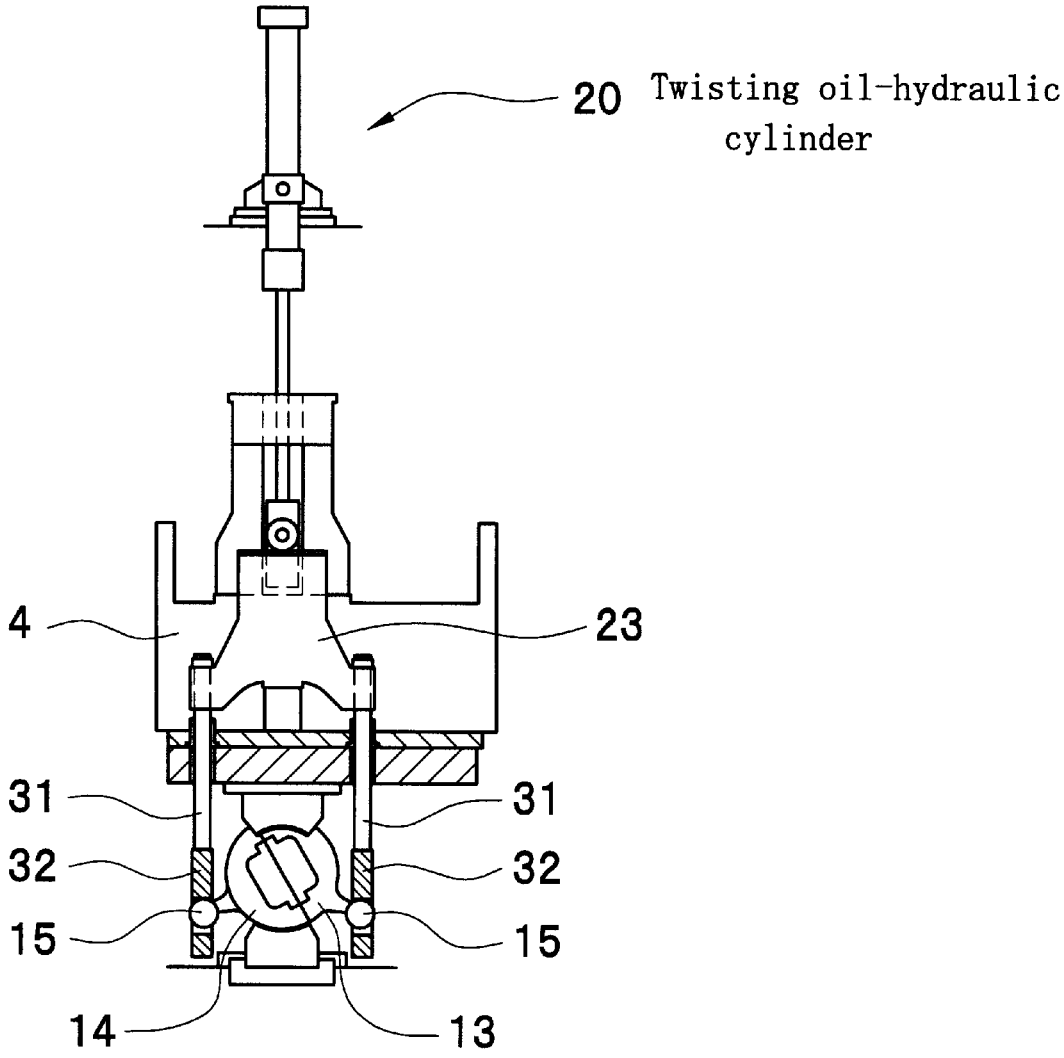
FIG. 7 is an explanatory drawing of the twisting stage II of the forming press of FIG. 1.

In the twisting stage II shown in FIG. 7, the twisting oil-hydraulic cylinder 20 extends to push down the pressing block 23, the push rods 31, and the twisting-down beams 32, which push down the push-down arms 15 of the upper retainer 13 to give a twist to the workpiece in the twisting die 10.

Figure 8:
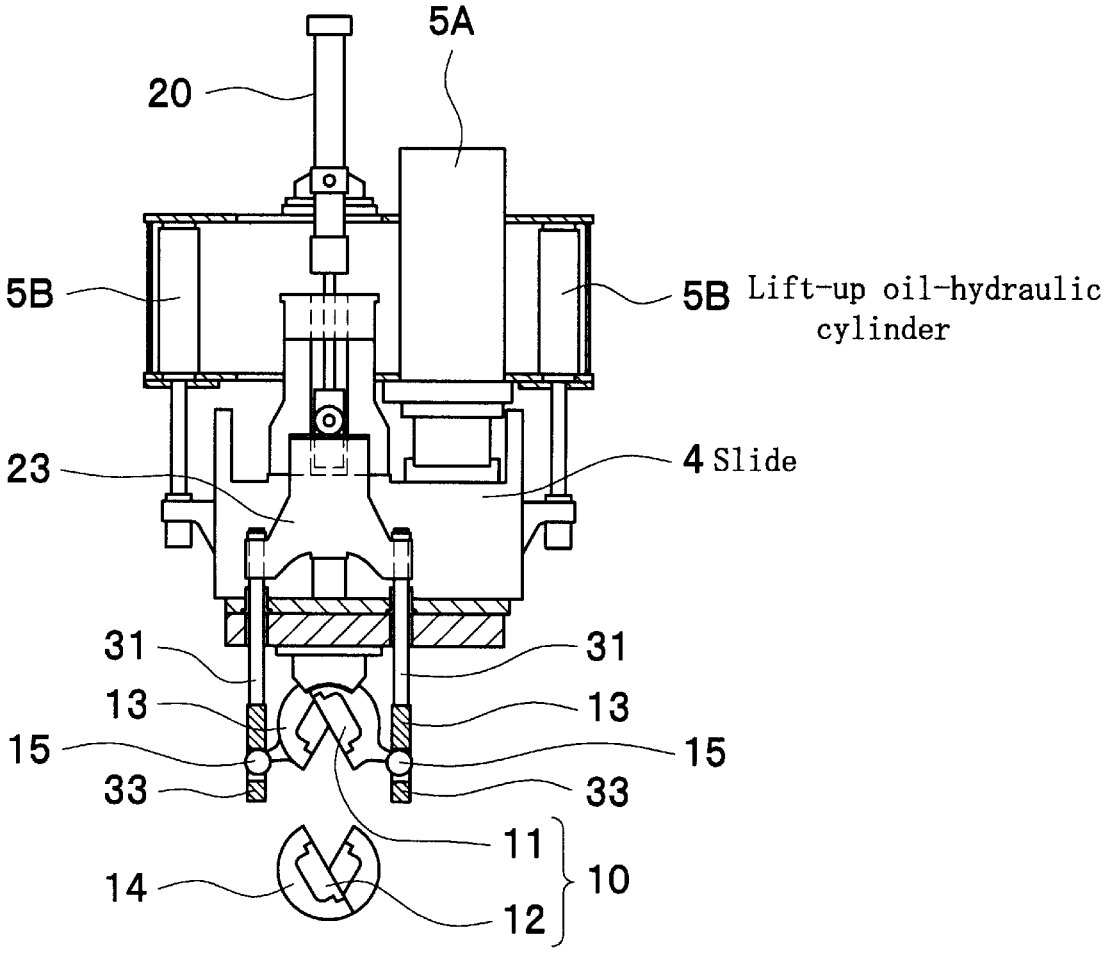
FIG. 8 is an explanatory drawing of the die-opening stage III of the forming press of FIG. 1.

In the die-opening stage III shown in FIG. 8, the lift-up oil-hydraulic cylinders 5B raise the slide 4, which raises the pressing block 23, the push rods 31, and the untwisting beams 33. Accordingly, the upper retainer 13 is raised from the lower retainer 14, and hence the upper and lower sections 11 and 12 of the twisting die 10 are separated from each other.

Figure 9:
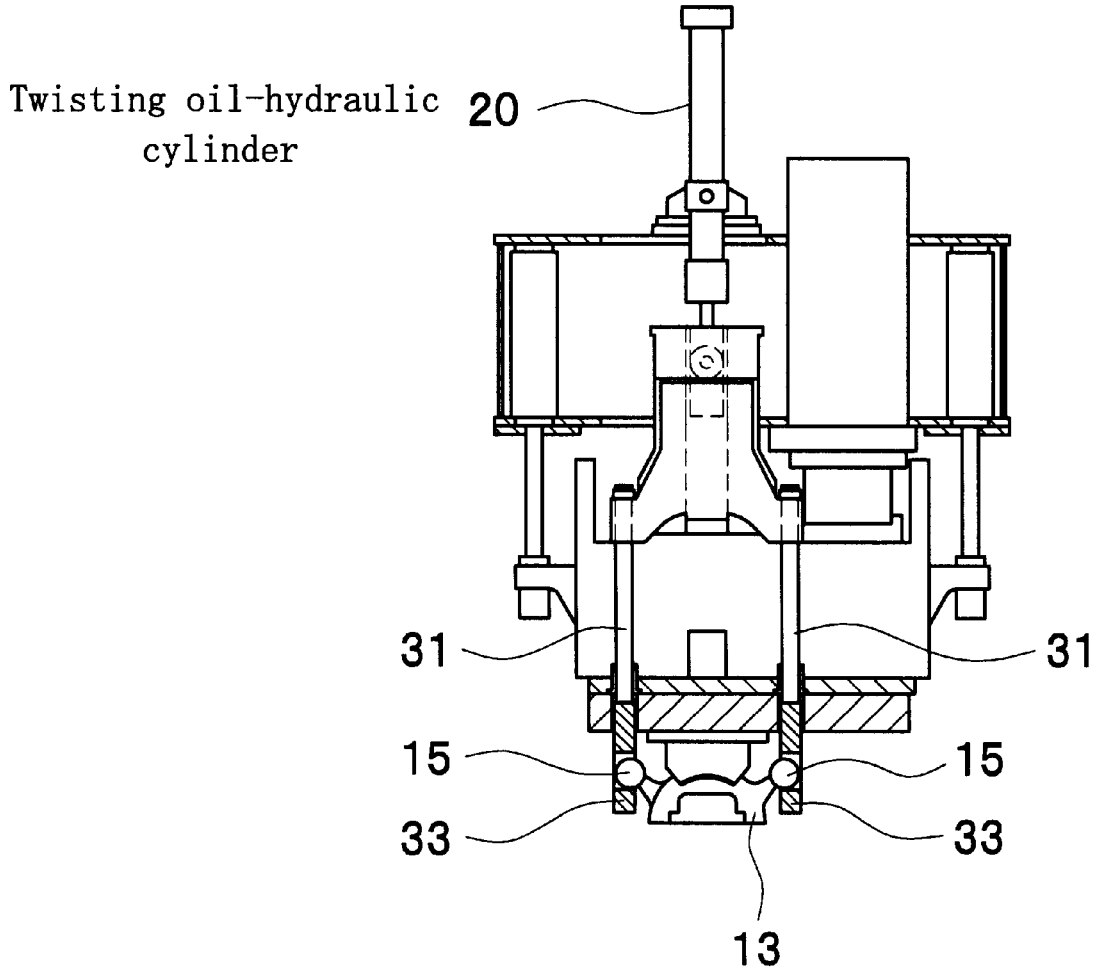
FIG. 9 is an explanatory drawing of the upper die section-untwisting stage IV of the forming press of FIG. 1.

In the upper die section-untwisting stage IV shown in FIG. 9, the twisting oil-hydraulic cylinder 2 is contracted to raise the push rods 31 and the untwisting beams 33, which turn upward the push-down arms 15 of the upper retainer 13.

Figure 10:
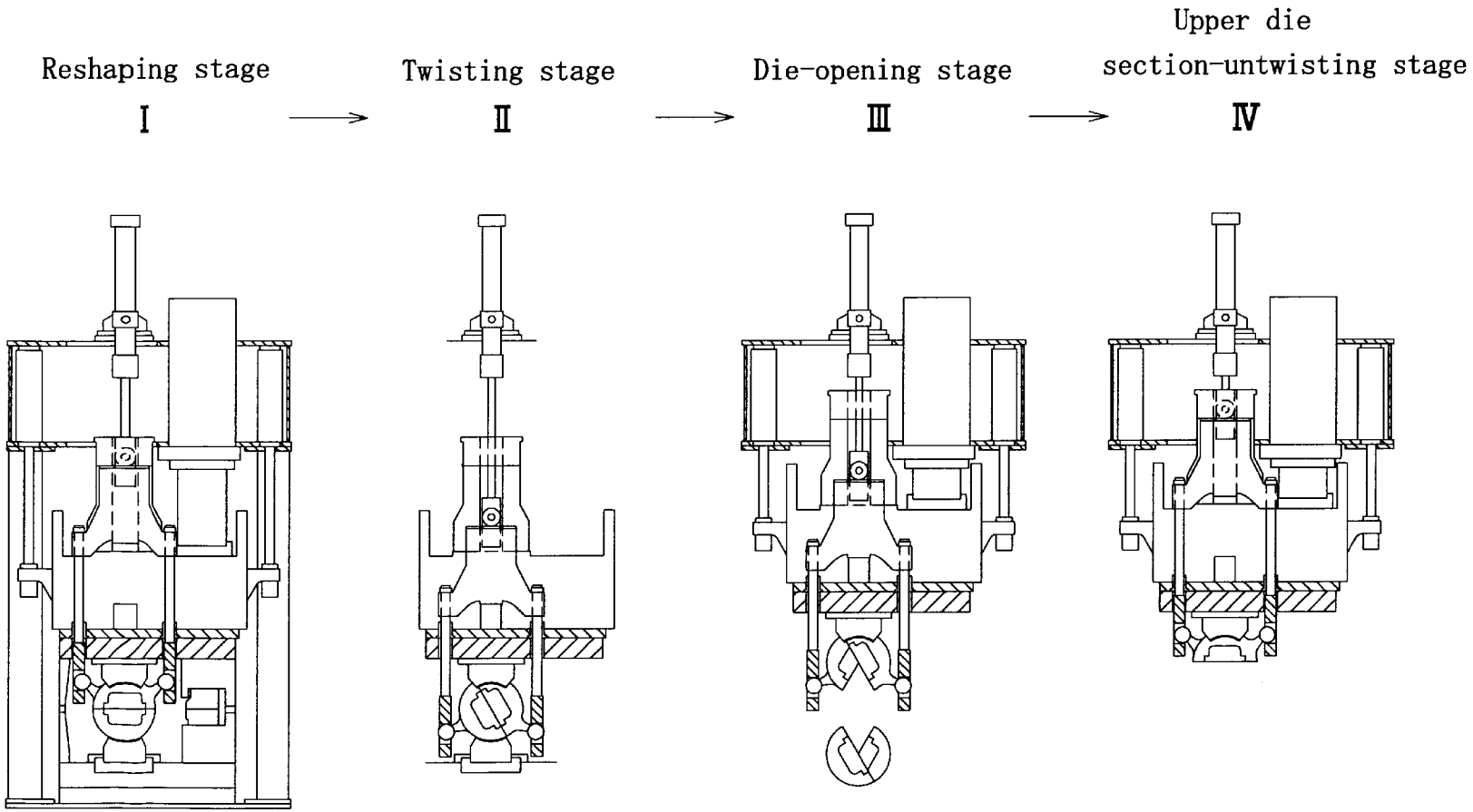
FIG. 10 shows the above four stages I–IV in sequence.

In this way, workpieces are twisted and formed into crankshafts. FIG. 10 shows all the four stages in sequence.

(Second Embodiment of the Invention)

Now, the basic structure of another preferred embodiment of forming press of crankshafts of the present invention will be described.

Figure 11:
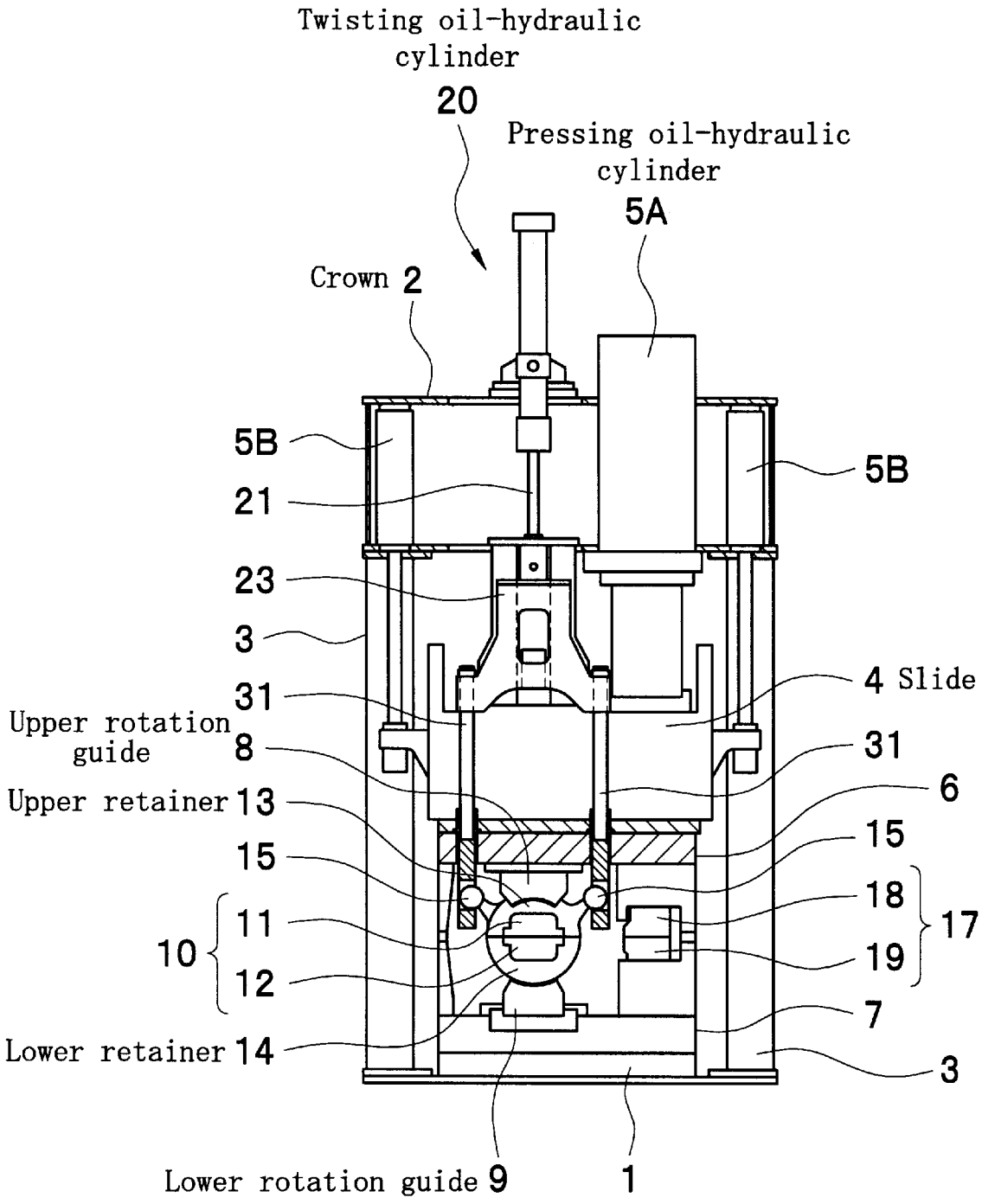
FIG. 11 is a front view of another embodiment of forming press of crankshafts of the present invention.

In FIG. 11, the numeral 1 represents a bed hard plate; 2, a crown; 3, columns connecting the bed hard plate 1 and the crown 2. The numeral 4 indicates a slide. The signs 5A and 5B represent a pressing oil-hydraulic cylinder and lift-up oil-hydraulic cylinders, respectively, both mounted on the crown 2. When the rod-side chambers of the lift-up cylinders 5B are opened and, at the same time, the pressing cylinder 5A is allowed to suck in hydraulic oil from a tank, the slide 4 descends. The slide 4 has, in cross section, a tall rectangular body and a wide base plate, the two portions generally constituting an inverted T-form.

An upper die holder 6 is secured to the bottom of the slide 4. A lower die holder 7 is mounted on the top of the bed hard plate 1. An upper rotation guide 8 and the upper section 18 of a reshaping die 17 are secured to the bottom of the upper die holder 6. A lower rotation guide 9 and the lower section 19 of the reshaping die 17 are mounted on the top of the lower die holder 7.

The construction of the forging unit for twisting is as follow. The twisting die 10 consists of an upper section 11 and a lower section 12. The upper section 11 is fitted in an upper retainer 13, which is journaled in the upper rotation guide 8. The lower section 12 is fitted in a lower retainer 14, which is journaled in the lower rotation guide 9. The detailed construction of the forging unit for twisting is the same as the detailed construction shown in FIG. 4.

Figure 12:
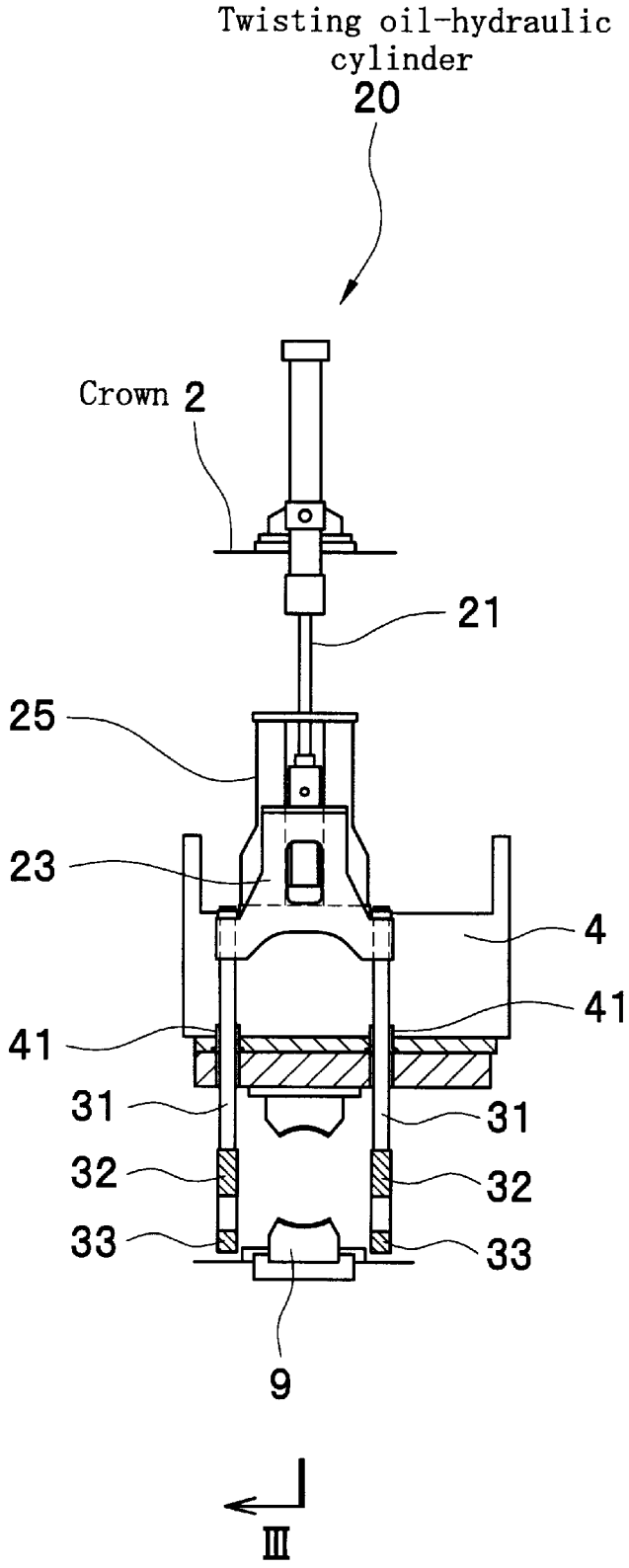
FIG. 12 is a front view of the main part of the forming press of FIG. 11, its twisting oil-hydraulic cylinder fully extended.
Figure 13:
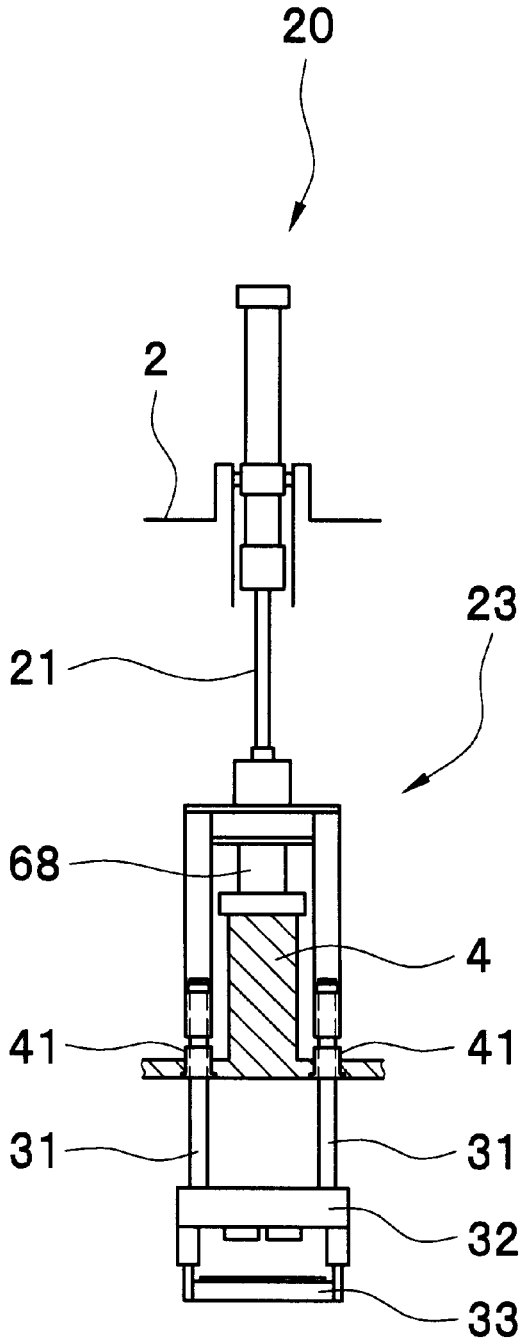
FIG. 13 is a view taken along the arrowed line III of FIG. 12.

In FIGS. 11 to 13, the numeral 20 represents a twisting oil-hydraulic cylinder, which is mounted on the crown 2. The oil-hydraulic circuit for operating the twisting cylinder 20 is the same as the circuit shown in FIG. 5.

The lower end of the piston rod 21 of the twisting oil-hydraulic cylinder 20 is connected to a pressing block 23. Secured to each of the four corners of the pressing block 23 is the upper end of a twisting push rod (hereinafter referred to as "push rod") 31.

Two of the four push rods 31 are disposed in front and back of the body of the slide 4 (see FIG. 13) on the right side of the twisting die 10 (see FIG. 11); the other two, in front and back of the body of the slide 4 on the left side of the twisting die 10. The bottom portions of the front and rear push rods 31 and 31 on the right side of the twisting die 10 are connected to each other by a twisting-down beam 32 and an untwisting beam 33. In the same way, the bottom portions of the front and rear push rods 31 and 31 on the left side of the twisting die 10 are connected to each other by a twisting-down beam 32 and an untwisting beam 33.

Thus, because the upper ends of the push rods 31 are secured to the pressing block 23 and their lower ends are connected to each other by the twisting-down beams 32 and the untwisting beams 33, the twisting mechanism can be constructed with higher rigidity and less weight.

The rollers 15*a* of the push-down arms 15 of the upper retainer 13 are put between the twisting-down beam 32 and the untwisting beam 33 on each side of the twisting die 10.

Thus, because two or more push-down arms 15 are arranged side by side along the twisting-down beam 32 and the untwisting beam 33, both having a suitable length, on each side of the twisting die 10, it is unnecessary to change the push rods 31, the twisting-down beams 32, and the untwisting beams 33 regardless of different sizes of crankshafts, and hence different sizes of the upper and lower retainers 13 and 14, and hence different positions of the push-down arms 15.

Now the means for setting the twisting angle of the forming press will be described.

Figure 14:
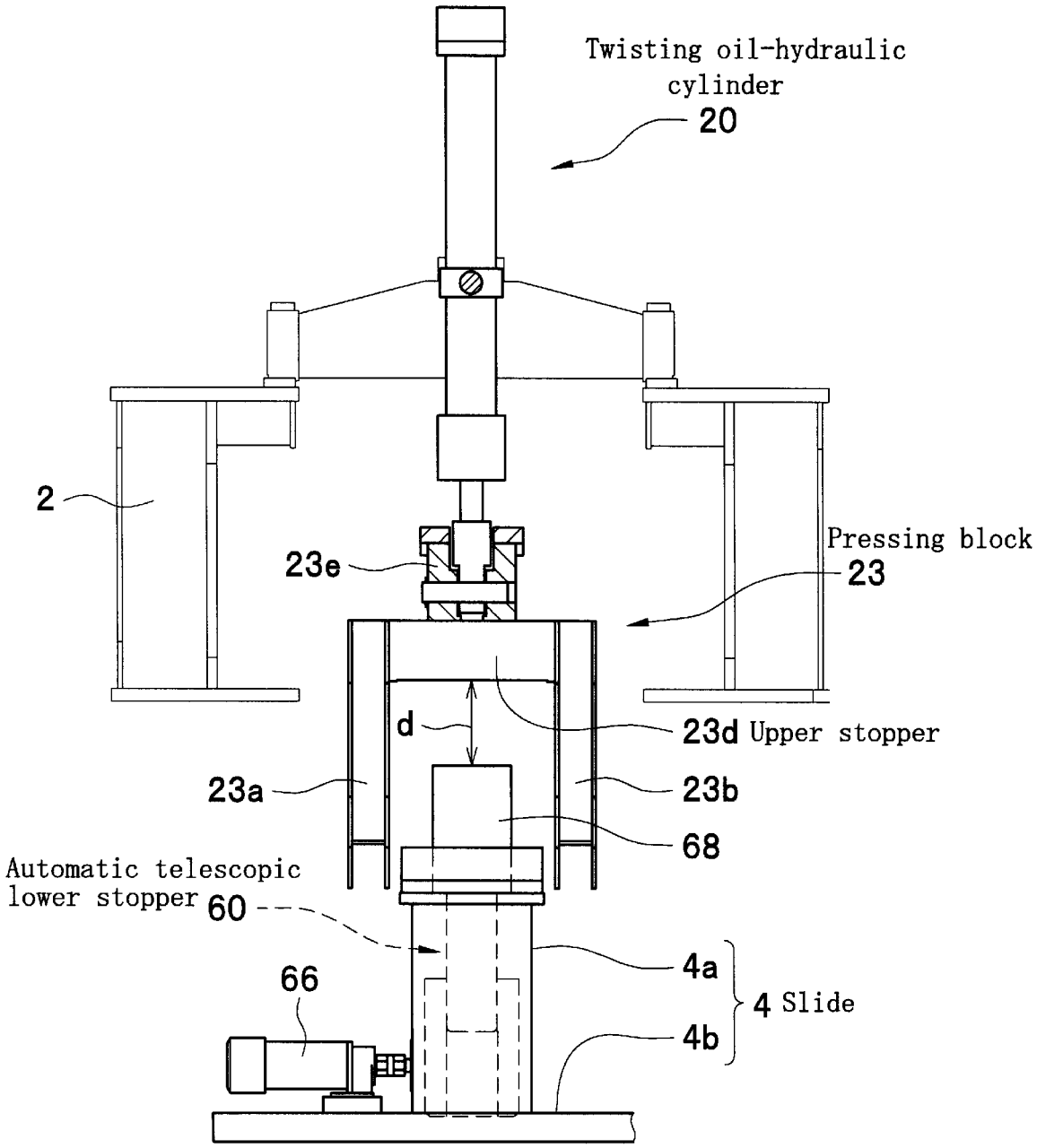
FIG. 14 is a side view of the means for setting the twisting angle of the forming press of FIG. 11

As shown in FIG. 14, the means for setting the twisting angle comprises an upper stopper 23*d* on the pressing block 23's side and an automatic telescopic lower stopper 60 on the slide 4's side.

The construction of the pressing block 23 with the upper stopper 23*d* will be described first. The lower end of the piston rod 21 of the twisting oil-hydraulic cylinder 20 is connected to a bracket 23*e* which is mounted on the upper stopper 23*d*. Block members 23*a* and 23*b* are secured to the front and the back, respectively, of the upper stopper 23*d*. These three members are arranged in an H-like shape as seen from above them and in an inverted U-like shape as seen from one side. The pressing block 23 is disposed astride of the body 4*a* of the slide 4. A push rod 31 is secured at each of the right and left end portions of each of the block members 23*a* and 23*b* as mentioned earlier (see FIGS. 12 and 13). The upper stopper 23*d* plays also the roll of connecting member between the block members 23*a* and 23*b*.

The body 4*a* of the slide 4 is provided with the automatic telescopic lower stopper 60, which takes a position below the center of the upper stopper 23*d* and of which the center is aligned with the axis of the twisting oil-hydraulic cylinder 20.

Figure 15:
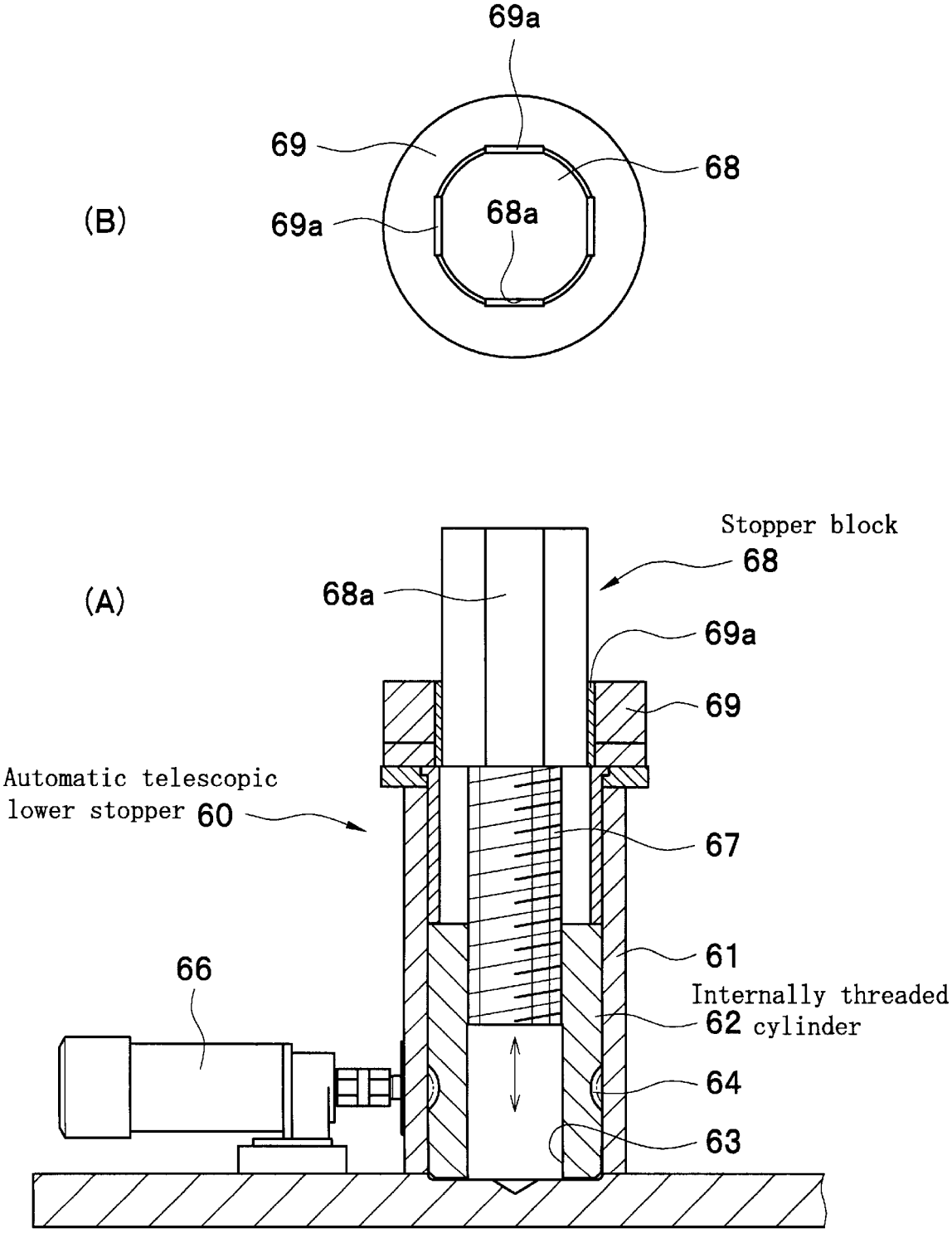
FIG. 15(A) is a sectional view of the twisting angle-setting means of FIG. 14, and FIG. 15 (B) is a plan view of the stopper block 68 of FIG. 15(A)
Figure 16:
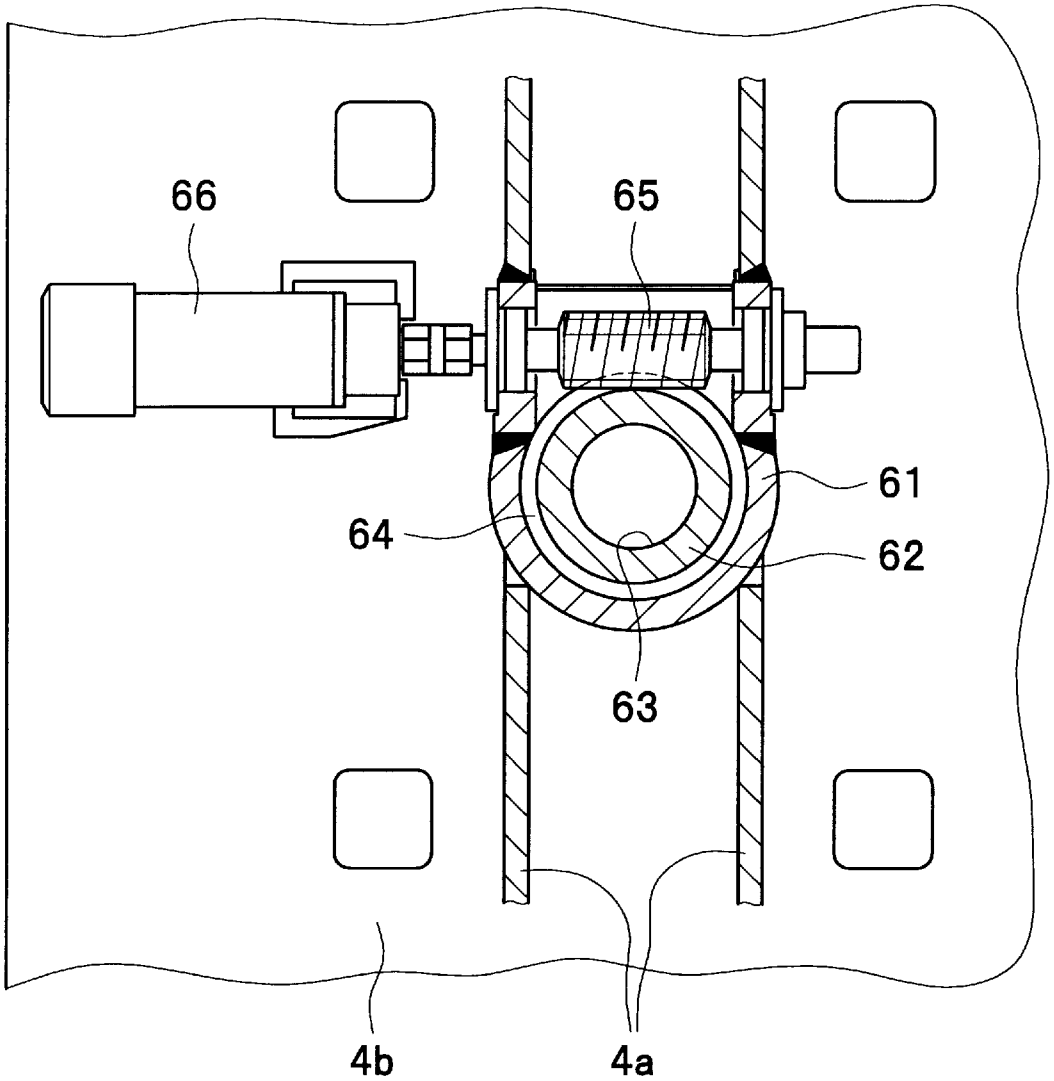
FIG. 16 is a plan view of the twisting angle-setting means of FIG. 14.

As shown in FIGS. 15 and 16, a cylindrical casing 61 is secured to the body 4*a* of the slide 4. An internally threaded cylinder 62 is inserted in the casing 61 so as to be freely rotatable about its vertical axis. Internal threads 63 are formed on the inner surface of the cylinder 62. Besides, a worm wheel 64 is formed on the outer surface of the internally threaded cylinder 62. Engaged with the worm wheel 64 is a worm 65, which can be rotated in either direction by an electric motor 66. On the other hand, an externally threaded member 67 is engaged with the internal threads 63 of the internally threaded cylinder 62. A stopper block 68 is fixed on the top of the externally threaded member 67. Four sliding surfaces 68*a* are formed in the vertical direction on the periphery of the stopper block 68. Provided on the upper end of the casing 61 is a guide member 69, which has four shoes 69*a* slidingly in contact with the sliding surfaces 68*a* to prohibit the stopper block 68 from turning and guide the stopper block 68 up and down.

With the above configuration, when the electric motor 66 rotates in one or the other direction, the internally threaded cylinder 62 rotates to raise or lower the externally threaded member 67 and hence the stopper block 68. Thus, as shown in FIG. 14, the spacing "d" between the upper stopper 23*d* and the stopper block 68, namely, the descending stroke of the pressing block 23, or the push rods 31, relative to the slide 4 can be adjusted.

Although the worm 65 can turn the worm wheel 64, the worm wheel 64 cannot rotate the worm 65. Therefore, the externally threaded member 67 and the internally threaded cylinder 62 do not turn in the reverse direction under the downward force acting on the stopper block 68, and hence the set twisting angle is not disturbed during the operation of the forming press. Besides, by setting the lead angle of the threads of the externally threaded member 67 and the internally threaded cylinder 62 small, the stopper block 68 can be prevented from turning under the downward force working on it. Thus, its stability can be further increased.

Figure 17:
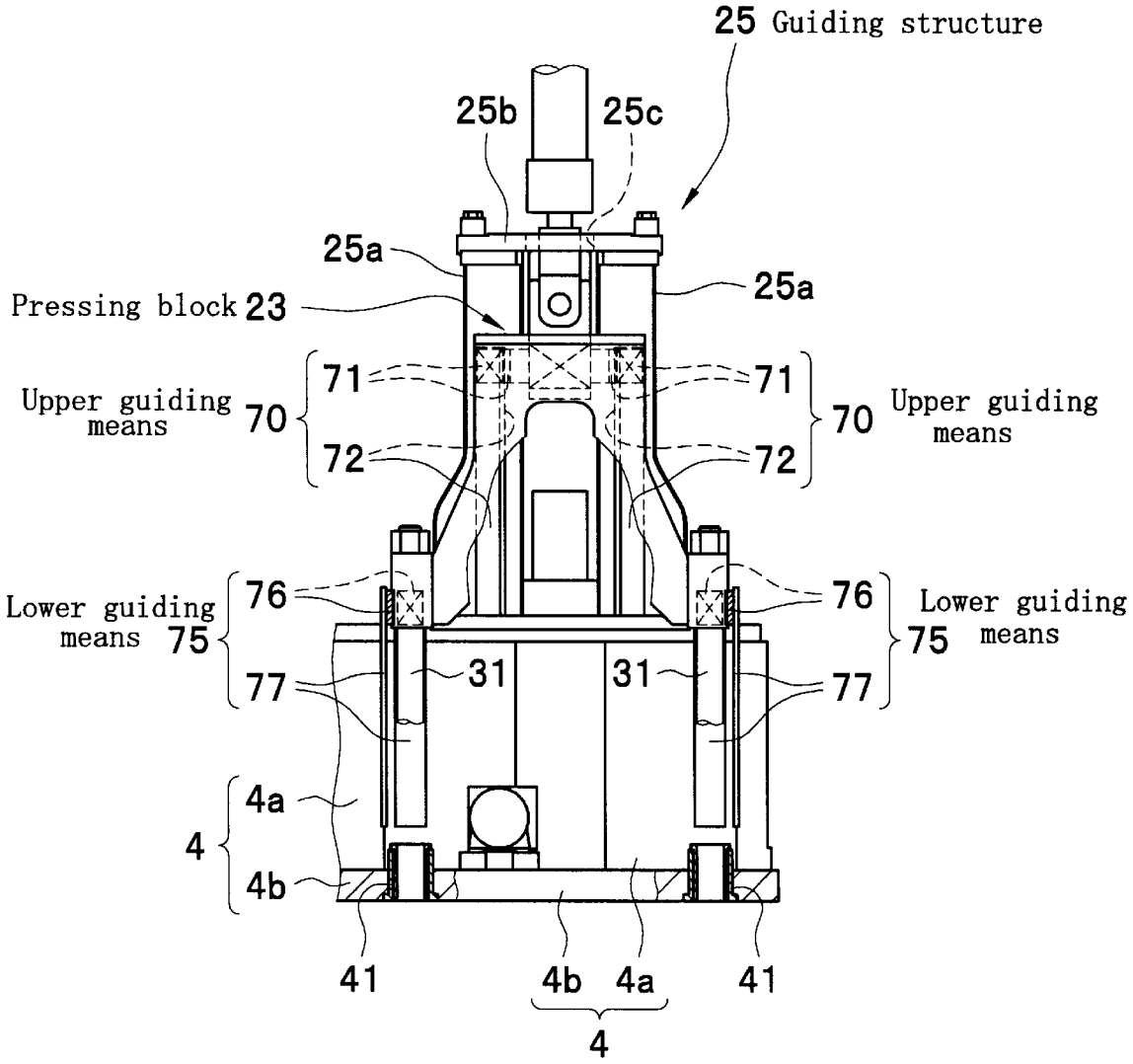
FIG. 17 is a front view of the means for guiding the pressing block of the forming press of FIG. 11, the view taken along the arrowed line VIII—VIII of FIG. 20.
Figure 18:
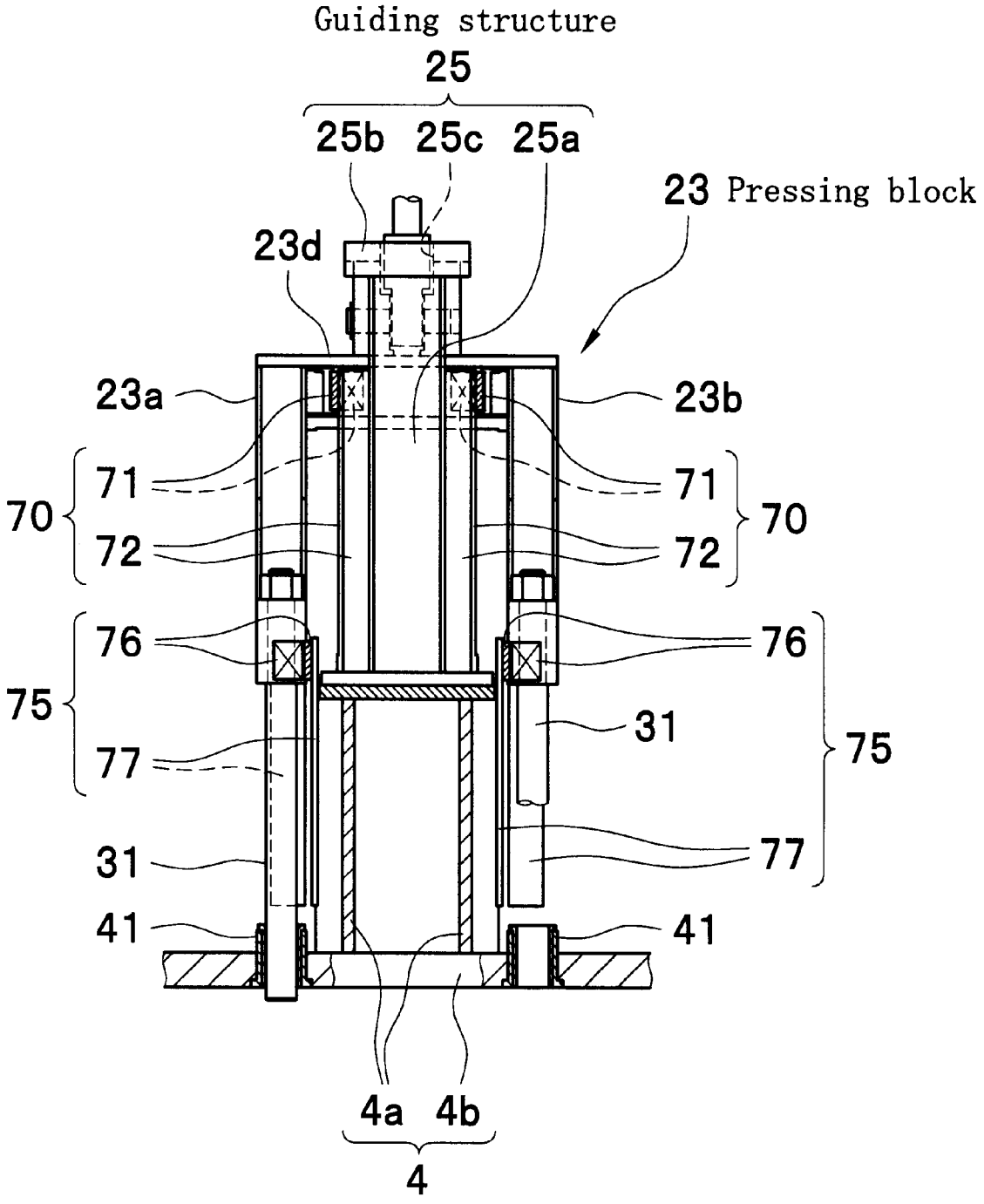
FIG. 18 is a side view of the guiding means of FIG. 17.
Figure 19:
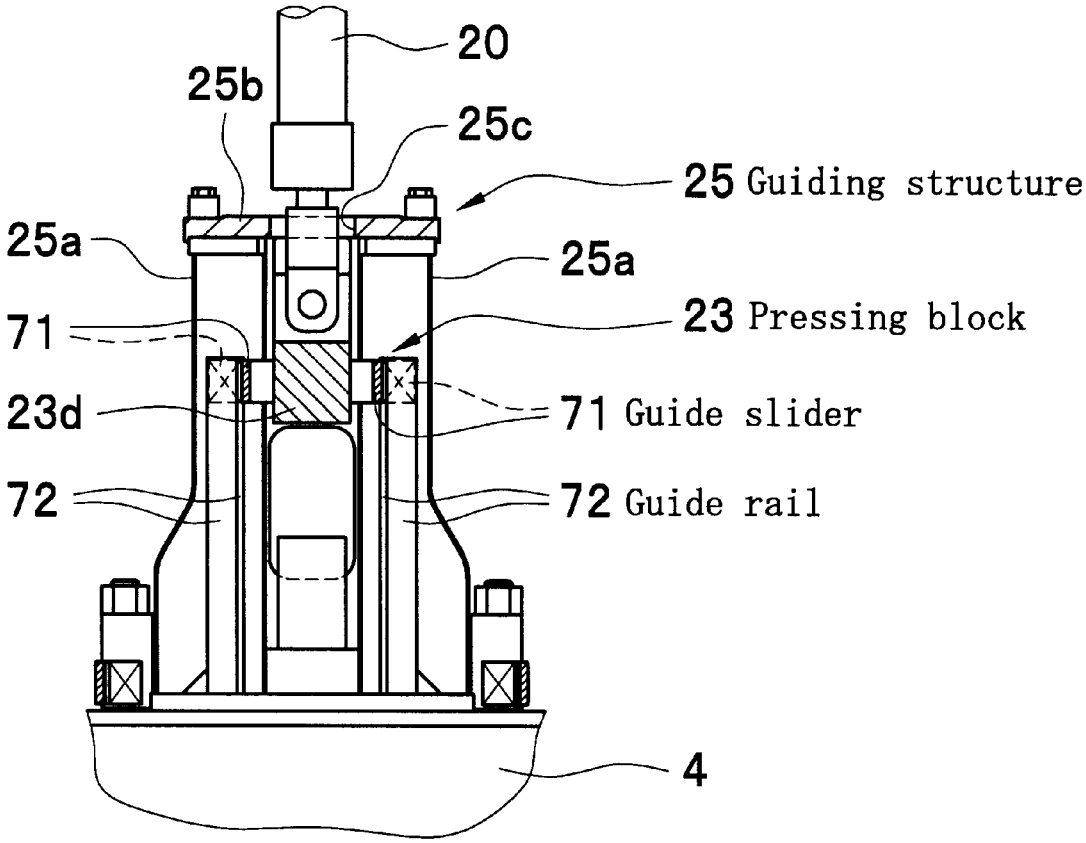
FIG. 19 is a front view of the upper guiding means of the guiding means FIG. 17.
Figure 20:
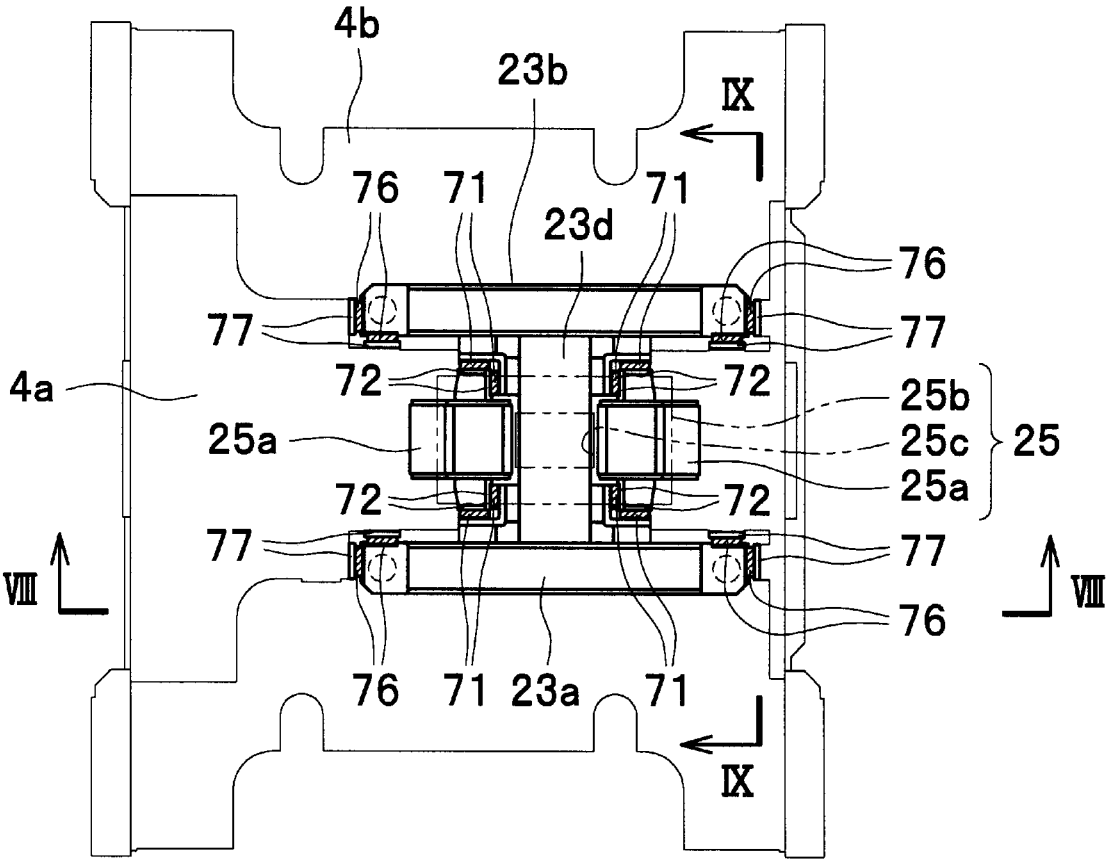
FIG. 20 is a plan view of the guiding means of FIG. 17.

Referring to FIGS. 17 to 20, the means for guiding the pressing block 23 will now be described. In FIG. 17, the numeral 25 represents a guide structure, which is mounted fixedly on the top of the slide 4. As shown in FIGS. 18 to 20, the guide structure 25 comprises two columns 25*a* and 25*a* and a member 25*b* connecting the upper ends of the two columns 25*a* and 25*a*. An opening 25*c* is formed in the center of the connecting member 25*b* to let through the piston rod 21 of the twisting oil-hydraulic cylinder 20. The upper stopper 23*d* of the pressing block 23 is so disposed below the connecting member 25*b* of the guide structure 25 that the connecting member 25*b* and the upper stopper 23*d* cross each other at a right angle as seen from above them. The block members 23*a* and 23*b* are disposed in front and back of, and in parallel with, the connecting member 25*b* (see FIG. 20).

With the pressing block 23 and the guide structure 25 so constructed and disposed, an upper guiding means 70 and a lower guiding means 75, both constituting the above-mentioned means for guiding the pressing block 23, are constructed as follows.

As shown in FIGS. 17 to 20, four guide sliders 71 are attached to such four spots of the upper portion of the pressing block 23 (that is, of the upper stopper 23*d* and the upper portions of the block members 23*a* and 23*b*) as are diagonally symmetrical about the connection between the lower end of the piston rod 21 of the twisting oil-hydraulic cylinder 20 and the upper stopper 23*d*. Each guide slider 71 consists of a part facing inward of the forming press, that is, to the front or the rear of the forming press, as the case may be, and a part facing outward of the forming press, that is, to the right or the left of the forming press, as the case may be.

On the other hand, four guide rails 72 are so attached to the right and left columns 25*a* and 25*a* of the guide structure 25 that their positions are diagonally symmetrical about the center of the guide structure 25 as seen from above them. The length of the guide rails 72 corresponds to the stroke of the pressing block 23. Each guide rail 72 consists of a art facing outward of the forming press, that is, to the rear or the front of the forming press, as the case may be, and a part facing inward of the forming press, that is, to the left or the right of the forming press, as the case may be. The four guide sliders 71 slide on the four guide rails 72, and thereby the pressing block 23 is guided and prevented from slanting back and forth or right and left while it is moving up and down.

The construction of the lower guiding means 75 is as follows. As shown in FIGS. 17, 18, and 20, four guide sliders 76 are attached to both ends of the front block member 23*a* and both ends of the rear block member 23*b*, namely, the four corners of the pressing block 23, each corner holding a push rod 31. Each guide slider 76 consists of a part facing inward of the forming press, that is, to the front or the rear of the forming press, as the case may be, and a part facing outward of the forming press, that is, to the right or the left of the forming press, as the case may be.

On the other hand, four guide rails 77 are so attached to the body 4*a* of the slide 4 that their positions correspond to those of the four guide sliders 76. The length of the guide rails 77 also corresponds to the stroke of the pressing block 23. Each guide rail 77 consists of a part facing outward of the forming press, that is, to the rear or the front of the forming press, as the case may be, and a part facing inward of the forming press, that is, to the left or the right of the forming press, as the case may be.

The four guide sliders 76 slide on the four guide rails 77, and thereby the pressing block 23 is guided and prevented from slanting back and forth or right and left while it is moving up and down.

As described above, because the upper and lower guiding means guide the upper and lower portions of the pressing block 23, the pressing block 23 does not slant and the lower ends of the four push rods 31 descend to one and the same level. Besides, although only one set of upper and lower stoppers 23*d* and 60 is provided directly below the axis of the twisting oil-hydraulic cylinder 20, the pressing block 23 presents no slant and the lower ends of the four push rods 31 are at one and the same level when the pressing block 23 has descended to the bottom of its stroke and been checked by the lower stopper 60 because each of the upper and lower guiding means guides the pressing block 23 at four spots around the lower stopper 60. Thus, high forming precision can be achieved.

Referring to FIGS. 21 to 24, the crankshaft-forming process of the forming press of the present embodiment will be described.

Figure 21:
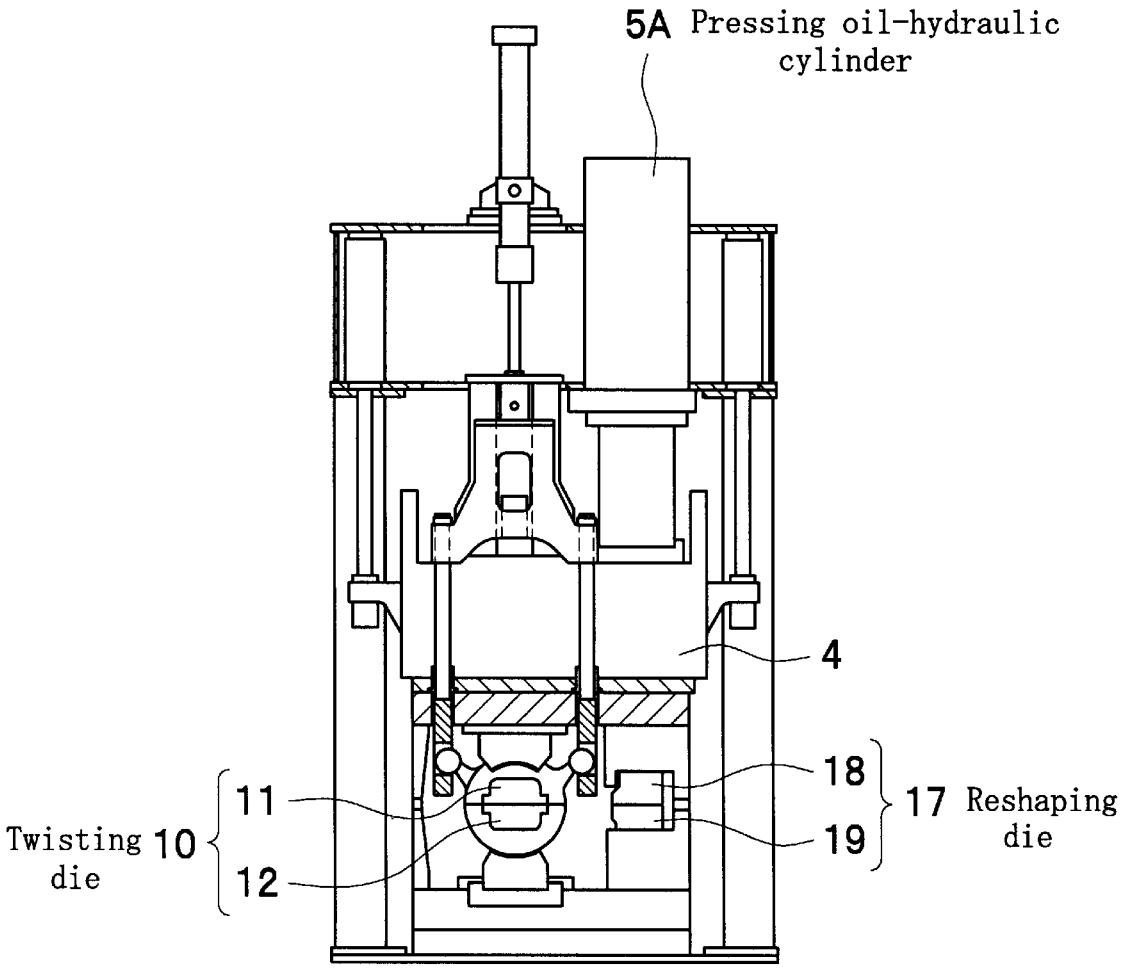
FIG. 21 is an explanatory drawing of the reshaping stage I of the forming press of FIG. 11.

In the reshaping stage I shown in FIG. 21, the pressing oil-hydraulic cylinder 5A extends to push down the slide 4, a workpiece not yet twisted is caught between the upper and lower sections 11 and 12 of the twisting die 10, and another workpiece already twisted is pressed and reshaped in the reshaping die 17.

Figure 22:
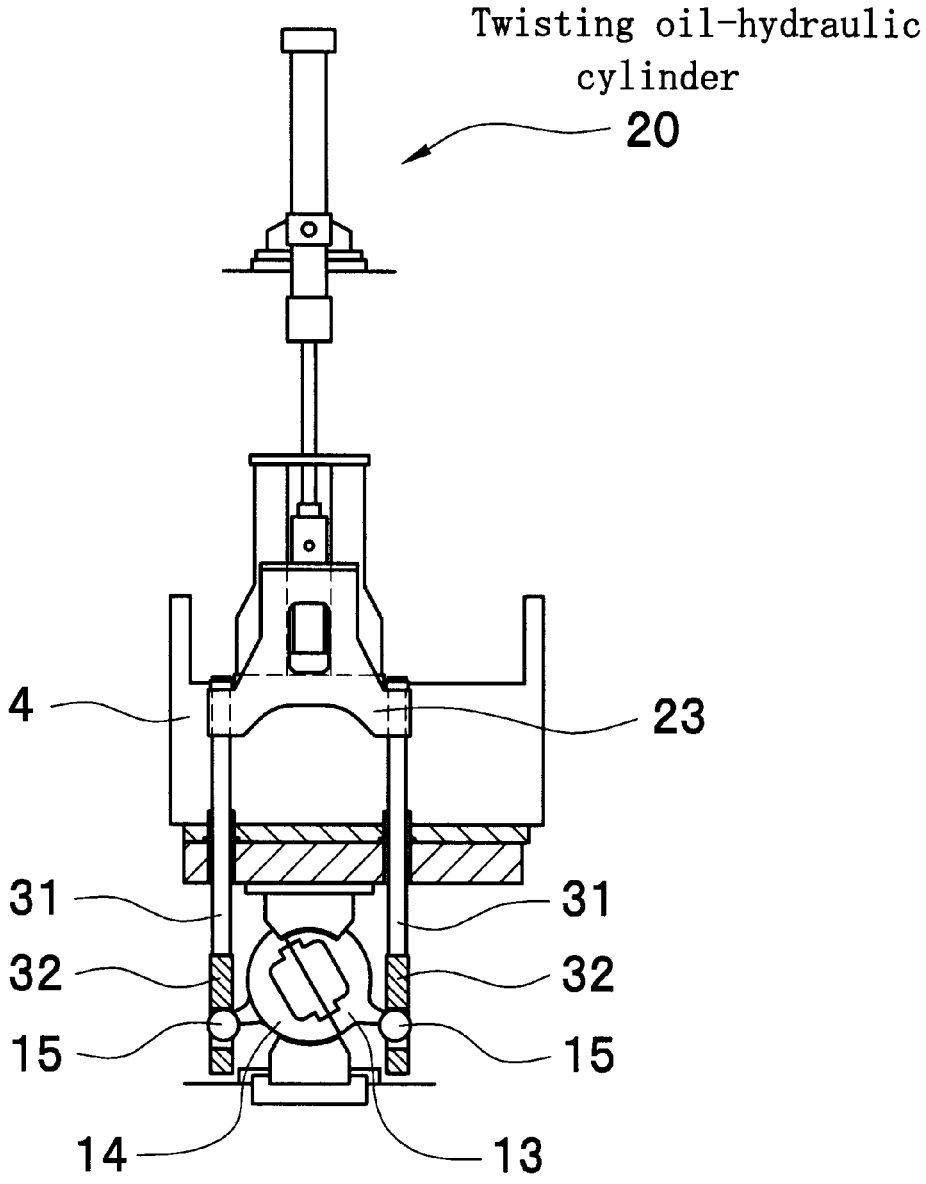
FIG. 22 is an explanatory drawing of the twisting stage II of the forming press of FIG. 11.

In the twisting stage II shown in FIG. 22, the twisting oil-hydraulic cylinder 20 extends to push down the pressing block 23, the push rods 31, and the twisting-down beams 32, which push down the push-down arms 15 of the upper retainer 13 to give a twist to the workpiece in the twisting die 10.

Figure 23:
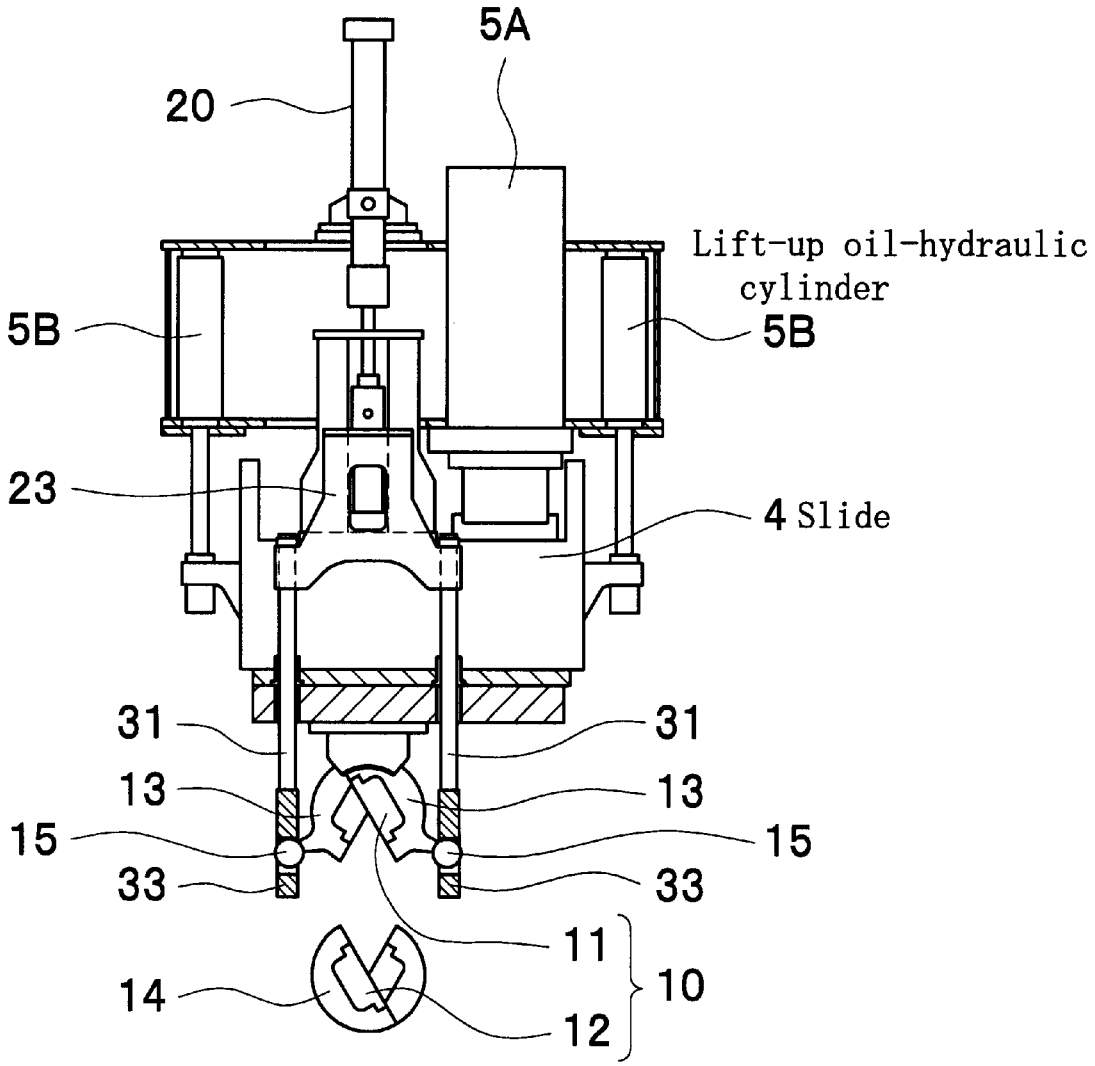
FIG. 23 is an explanatory drawing of the die-opening stage III of the forming press of FIG. 11.

In the die-opening stage III shown in FIG. 23, the lift-up oil-hydraulic cylinders 5B raise the slide 4, which raises the pressing block 23, the push rods 31, and the untwisting beams 33. Accordingly, the upper retainer 13 is raised from the lower retainer 14, and hence the upper and lower sections 11 and 12 of the twisting die 10 are separated from each other.

Figure 24:
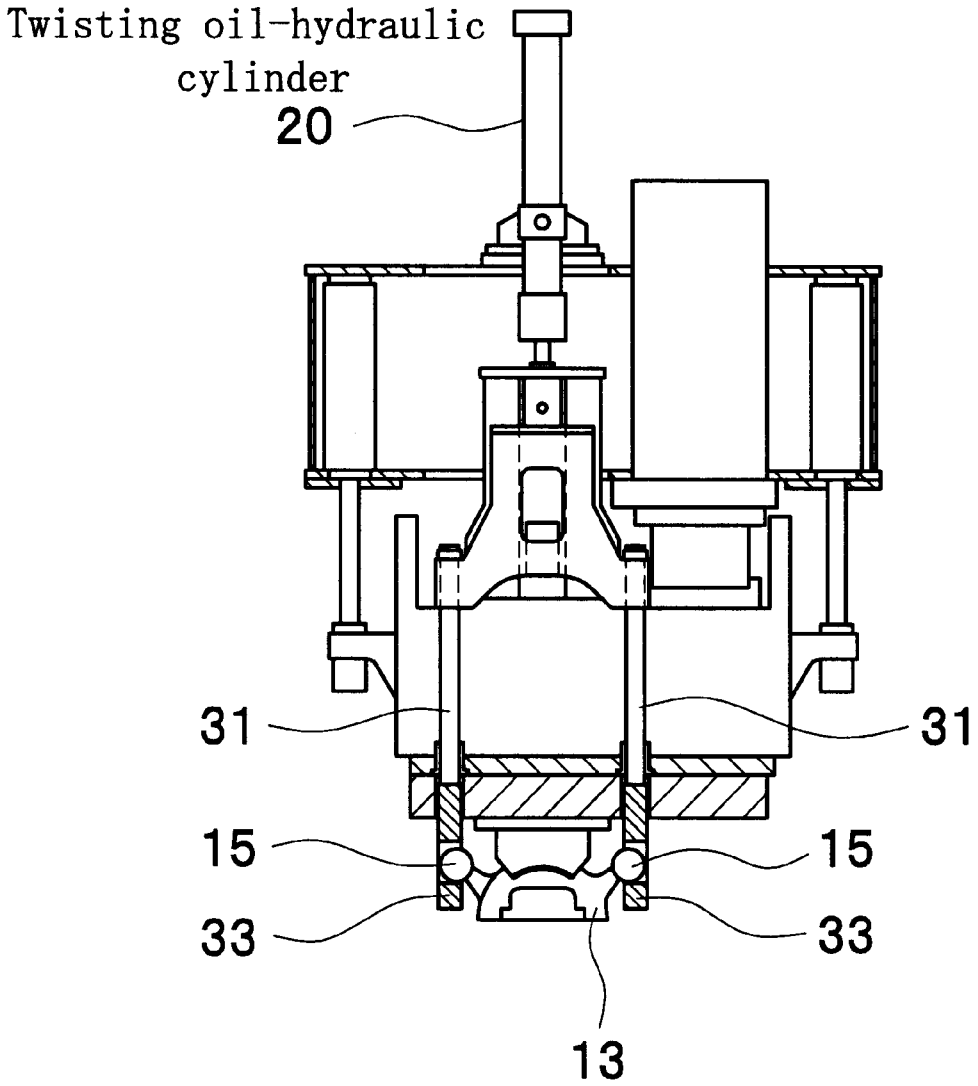
FIG. 24 is an explanatory drawing of the upper die section-untwisting stage IV of the forming press of FIG. 11.
Figure 25:
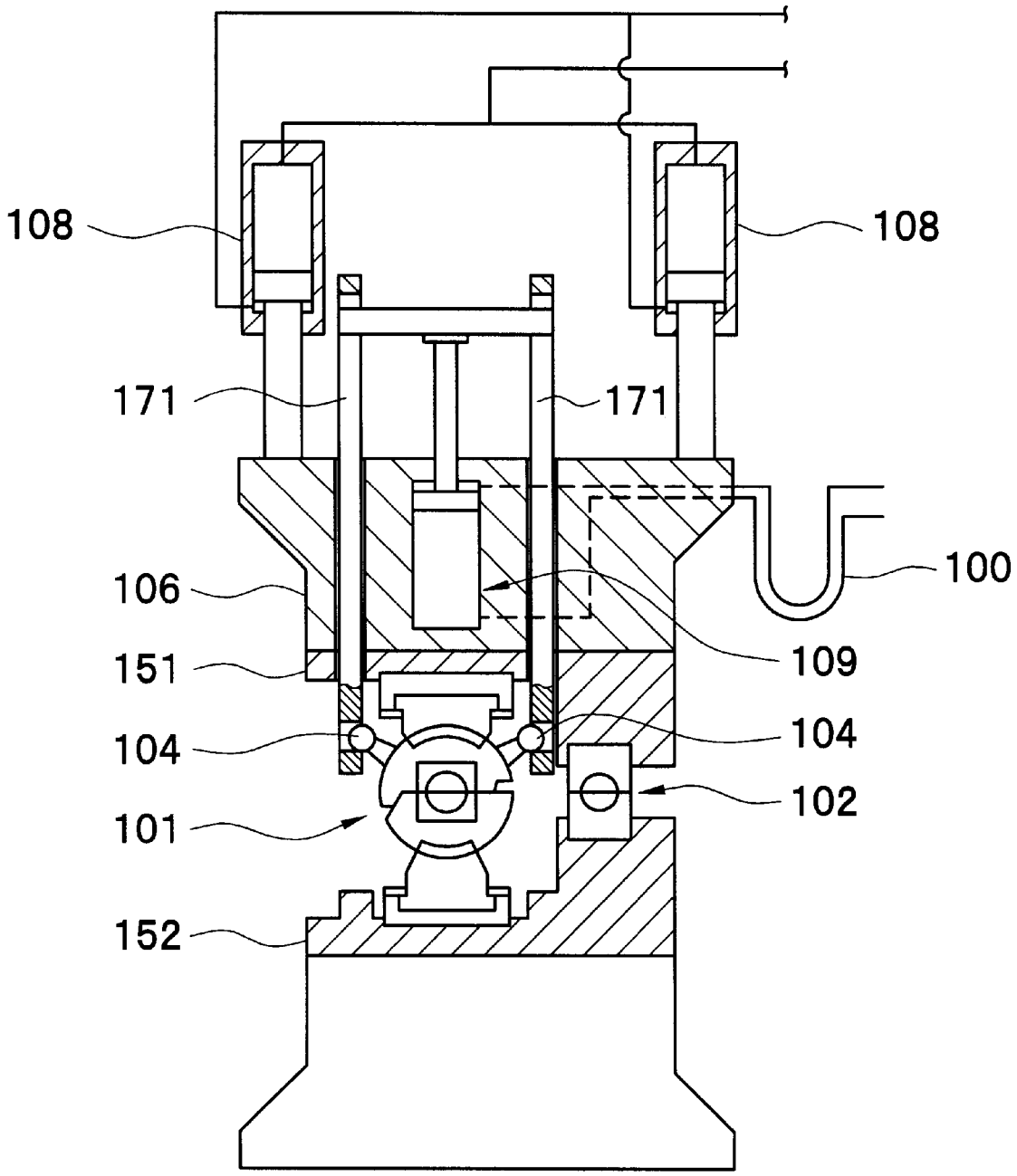
FIG. 25 (PRIOR ART)
FIG. 25 is a sectional front view of the main part of the forming press of crankshafts of a prior art.

In the upper die section-untwisting stage IV shown in FIG. 24, the twisting oil-hydraulic cylinder 20 is contracted to raise the push rods 31 and the untwisting beams 33, which turn upward the push-down arms 15 of the upper retainer 13.

In this way, workpieces are twisted and formed into crankshafts.

The invention may be embodied in other specific forms without departing from the spirit or essential characteristics thereof. The above embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What we claim is:

1. A forming press of crankshafts having a crown, a slide, a forging unit for twisting with a twisting die, and a forging unit for reshaping, wherein:

a pressing oil-hydraulic cylinder and a lift-up oil-hydraulic for lowering and raising the slide and a twisting oil-hydraulic cylinder for twisting a workpiece in the forging unit for twisting are directly mounted on the crown, the lift-up oil-hydraulic cylinder and the twisting oil-hydraulic cylinder each having a piston rod with the pressing oil-hydraulic cylinder and lift-up oil-hydraulic cylinder being connected to the slide;

the piston rod of the twisting oil-hydraulic cylinder is connected to a pressing block having four corners;

a twisting push rod is secured to each of the four corners of the pressing block, two of the four twisting push rods being disposed in a front corner and a back corner relative to a right side of the twisting die, the other two twisting push rods being disposed in a front corner and a back corner relative to a left side of the twisting die; and lower ends of the two twisting push rods on each side of the twisting die are connected to each other by a twisting-down beam and an untwisting beam below the slide.

2. A forming press as claimed in claim 1, wherein the slide is of inverted T-form in section, the pressing block is of inverted U-form as seen from one side, and the slide and the pressing block are so disposed to each other that the former can enter the latter.

3. A forming press as claimed in claim 2, wherein:

the pressing block comprises a guide shoe and a pair of block members secured to the front and the back of the guide shoe;

a pair of guide members for guiding the guide shoe upward and downward is mounted on the slide; and the slide has four guide pipes for guiding the four twisting push rods.

4. A forming press as claimed in claim 3, wherein the slide and a member provided as a unit with the slide are mounted with a lower stopper to define the descending limit of the pressing block relative to the slide and an upper stopper to define the ascending limit of the pressing block relative to the slide.

5. A forming press as claimed in claim 4, wherein:

a directional control valve is put in a hydraulic-oil feeding and discharging circuit which connects head-side and rod-side oil chambers of the twisting oil-hydraulic cylinder to a pressurized-oil source;

an opening and closing valve is put in a hydraulic-oil line which connects the head-side oil chamber of the twisting oil-hydraulic cylinder to an oil tank; and a relief valve and an opening and closing valve are put in series in a hydraulic-oil line which connects the rod-side oil chamber of the twisting oil-hydraulic cylinder to the oil tank.

6. A forming press as claimed in claim 1, wherein a means for setting the twisting angle is provided between the pressing block and the slide, the means comprising an upper stopper provided in the pressing block and an automatic telescopic lower stopper provided in the slide and freely movable toward and away from the upper stopper.

7. A forming press as claimed in claim 6, wherein the automatic telescopic lower stopper of the means for setting the twisting angle comprises:

an internally threaded cylinder freely rotatable about its vertical axis in a casing which is provided in the slide;

an externally threaded member which engages with the internal-thread portion of the internally threaded cylinder;

a stopper block fixed on the top of the externally threaded member; and a driving mechanism for rotating the internally threaded cylinder.

8. A forming press as claimed in claim 7, wherein the driving mechanism of the automatic telescopic lower stopper comprises:

a worm wheel formed on the outer surface of the internally threaded cylinder;

a worm which engages with the worm wheel; and a geared motor for rotating the worm.

9. A forming press as claimed in claim 6, wherein a means for guiding the ascent and descent of the pressing block is provided between the pressing block and the slide, the means comprising:

an upper guiding means which includes four guide sliders attached to the four corners of the upper portion of the pressing block, a guide structure mounted fixedly on the top of the slide, and four guide rails attached to the guide structure for guiding the guide sliders; and a lower guiding means which includes four guide sliders attached to the four corners of the lower portion of the pressing block and four guide rails attached to the slide for guiding the four guide sliders.

10. A forming press as claimed in claim 9, wherein the guide slider and the guide rail, at each corner of the pressing block, of each of the upper guiding means and the lower guiding means are so configured that the guide slider consists of two parts and the guide rail consists of two parts, and one set of a guide-slider part and a guide-rail part guides the pressing block against its deviation to the front or the rear, as the case may be, of the forming press and the other set of a guide-slider part and a guide-rail part guides the pressing block against its deviation to the right or the left, as the case may be, of the forming press.

* * * * *